US007454166B2

(12) United States Patent
Patsiokas et al.

(10) Patent No.: US 7,454,166 B2
(45) Date of Patent: Nov. 18, 2008

(54) SYSTEM AND METHOD FOR PROVIDING RECORDING AND PLAYBACK OF DIGITAL MEDIA CONTENT

(75) Inventors: Stelios Patsiokas, Coral Springs, FL (US); Paul D. Marko, Pembroke Pines, FL (US); Robert Acker, Seattle, WA (US); Kenneth Lerner, Boca Raton, FL (US); Frank Falcone, Loxahatchee, FL (US); Gary Parsons, Potomac, MD (US)

(73) Assignee: XM Satellite Radio Inc., Washington, DC (US)

( * ) Notice: Subject to any disclaimer, the term of this patent is extended or adjusted under 35 U.S.C. 154(b) by 417 days.

(21) Appl. No.: 10/831,343

(22) Filed: Apr. 26, 2004

(65) Prior Publication Data

US 2004/0266336 A1 Dec. 30, 2004

Related U.S. Application Data

(60) Provisional application No. 60/488,089, filed on Jul. 18, 2003, provisional application No. 60/465,203, filed on Apr. 25, 2003.

(51) Int. Cl.
*H04H 40/00* (2008.01)

(52) U.S. Cl. ..... 455/3.06; 455/186.1

(58) Field of Classification Search ..... 455/3.02, 455/3.04, 3.06, 425, 414.1, 569.2, 90.1, 134–135
See application file for complete search history.

(56) References Cited

U.S. PATENT DOCUMENTS

| | | | | |
|---|---|---|---|---|
| 5,721,827 | A | 2/1998 | Logan et al. | 395/200.47 |
| 5,822,737 | A | 10/1998 | Ogram | 705/26 |
| 5,892,536 | A | 4/1999 | Logan et al. | 348/13 |
| 5,963,917 | A | 10/1999 | Ogram | 705/26 |
| 5,986,692 | A | 11/1999 | Logan et al. | 348/13 |
| 6,088,455 | A | 7/2000 | Logan et al. | 380/200 |
| RE36,801 | E | 8/2000 | Logan et al. | 348/571 |
| 6,154,452 | A | 11/2000 | Marko et al. | 370/321 |
| 6,229,824 | B1 | 5/2001 | Marko | 370/477 |
| 6,233,389 | B1 | 5/2001 | Barton et al. | 386/46 |
| 6,381,584 | B1 | 4/2002 | Ogram | 705/26 |
| 6,510,317 | B1 | 1/2003 | Marko et al. | 455/428 |
| 6,553,077 | B2 | 4/2003 | Rindsberg et al. | 375/260 |
| 6,564,003 | B2 | 5/2003 | Marko et al. | 386/69 |
| 6,608,399 | B2 | 8/2003 | McConnell et al. | 307/10.1 |
| 6,628,928 | B1 * | 9/2003 | Crosby et al. | 455/77 |

(Continued)

*Primary Examiner*—Edward Urban
*Assistant Examiner*—Tu X Nguyen
(74) *Attorney, Agent, or Firm*—Roylance, Abrams, Berdo & Goodman, L.L.P.

(57) ABSTRACT

A system and method for time-shifting a live broadcast, and facilitating the purchase of live or time-shifted broadcast content. The device records broadcast content being listened to by user, which gives the user the option to replay content. The device and method also provides a preview service that allows the user to experience fresh media content on a regular basis, even where a live signal is not available. The broadcast source broadcasts new content on a regular basis to avoid providing users with stale content. The user identifies content using the device and data is stored that corresponds to the identified content. The broadcast source or a third-party content provider uses the corresponding data to provide the identified content to the user. In addition to audio content, the device also provides and facilitates the acquisition of video, graphics, text or any other media content.

38 Claims, 16 Drawing Sheets

U.S. PATENT DOCUMENTS

| | | | | |
|---|---|---|---|---|
| 6,629,197 | B1 | 9/2003 | Bhogal et al. | 711/111 |
| 6,631,271 | B1 | 10/2003 | Logan | 455/456 |
| 6,665,659 | B1 | 12/2003 | Logan | 707/3 |
| 6,678,215 | B1 | 1/2004 | Treyz et al. | 368/10 |
| 6,681,176 | B2 | 1/2004 | Funk et al. | 701/207 |
| 6,697,944 | B1 | 2/2004 | Jones et al. | 713/168 |
| 6,904,264 | B1 * | 6/2005 | Frantz | 455/3.04 |
| 2002/0132575 | A1 | 9/2002 | Kesling et al. | |
| 2003/0014767 | A1 | 1/2003 | Stumphauzer, II | 725/131 |
| 2003/0093790 | A1 * | 5/2003 | Logan et al. | 725/38 |
| 2003/0135464 | A1 * | 7/2003 | Mourad et al. | 705/50 |
| 2004/0058641 | A1 * | 3/2004 | Acker | 455/3.02 |

* cited by examiner

Car Charger Kit

Headset Kit
LIVE or Playback

Home Charger Kit

Ear Jack Kit
Playback Only

SYSTEM AND METHOD FOR PROVIDING RECORDING AND PLAYBACK OF DIGITAL MEDIA CONTENT

This application claims the benefit of U.S. provisional application Ser. No. 60/465,203, filed on Apr. 25, 2003, and U.S. provisional application Ser. No. 60/488,089, filed on Jul. 18, 2003, the subject matter of both applications being hereby incorporated herein by reference.

FIELD OF THE INVENTION

The present invention relates to a device for reception and playback of a broadcast signal, and more specifically to the storage and time-shifted playback of broadcast content in user-selected channels in a broadcast stream, navigation of the stored content, as well as generation of user-specific information relating to the stored content, to enhance the user's enjoyment of the broadcast stream. The present invention further relates to providing a value-added preview service to media providers and other digital content download services, and to using a composite broadcast stream as the preview service, to facilitate the user's authorized acquisition of digital content.

BACKGROUND OF THE INVENTION

Digital music consumption (e.g., the acquisition of selected audio tracks for personal listening enjoyment) continues to increase with advances in digital music products such as on-line music services and devices for digital music storage and playback, such as MP3 players, and the like. In particular, media players such as MP3 players are gaining in popularity. The primary market for these players is people with active lifestyles who want to listen to music of their choice from a personal library of music, wherever they go including outdoors, indoors, in their cars, and at home, retail and/or office locations, among other locations. These portable players are typically used with headphones to allow personal enjoyment of music or other content, although a broader variety of digital music players including home audio and car products are becoming available.

Young people, in particular, have a strong desire for recording and playing music, talk shows and other content of their choice. The most likely consumers for digital music storage and playback devices are people for whom music is an important part of their lives, and who are willing to pay a monthly subscription or other fee for downloading or otherwise acquiring selected content. While MP3 libraries give users the flexibility to store and playback audio tracks of their choice, searching for and downloading the tracks can be time-consuming. Many potential consumers no longer want to spend the time it takes to create and manage an MP3 library, or to burn custom CD's. While it is recognized that "MP3" refers to a particular audio compression algorithm, as used herein, the term "MP3" is used to refer to digital music in general, and may include digital music using other compression algorithms, such as AAC, for example, unless otherwise specified.

In addition, existing download sources are not as comprehensive as, for example, the music library of a satellite digital audio radio service (SDARS) such as that of XM Satellite Radio. For example, some download sources only provide users access to recordings of one or more particular recording companies. Furthermore, one of the primary drivers for consumption of new music and other media is exposure to new content through spontaneous programmed broadcast content such as FM radio, television, and satellite radio such as XM Radio. In particular, exposure to a rich variety of content provided by XM radio is a powerful motivator to gain interest in, investigate and ultimately acquire new music and other media. Thus, a need exists for a personal and portable recording and playback device and content source that provides users with the spontaneous and diverse audio library of a SDARS or similar programming service, and an easy-to-use recording and playback device for facilitating the selection, storage and playback of content therefrom. More specifically, a need exists for a portable recording and playback device that is operable in conjunction with a broadcast content service such as a transportable personal satellite radio receiver that is optimized for use wherever live coverage permits.

Furthermore with existing services and broadcast media, often consumers hear music they like but do not know the name of the song or artist, for example. It requires too much effort to determine the name of the song or artist, and later find and acquire music or other media by that artist. A need therefore exists for a system to facilitate consumers acquiring media to enjoy based on their exposure to broadcast content. This type of facilitating system would be particularly powerful in connection with a broadcast from a rich and varied library such as the digital library of XM Satellite Radio, Inc.

Existing services have a number of additional drawbacks. For example, the free file-swapping programs (peer-to-peer swap systems such as Kazaa, Morpheus, and eDonkey2000) promote unauthorized use of downloaded content that exposes users to legal action by copyright holders. While the record industry has found it difficult to discourage people from unauthorized downloading, recent aggressive legal actions could make users begin to seriously consider switching to an authorized method of downloading music. Nonetheless, in addition to being free, one of the main advantages of these systems remains in spite of other legitimate services such as subscription services. The peer-to-peer systems provide a great variety of recordings available for download. Many of these songs or other recordings are no longer in print or otherwise available from the record companies.

Recent digital music services such as Pressplay, MusicNet, Rhapsody, MusicMatchMX, and eMusic among others, have offered large or unlimited amounts of music for a single monthly fee, although with restrictions on how or where it can be used. The subscription model or per-song charge models have been regarded as one potential response to file-swapping services, where a vast amount of music is available at no charge. The subscription model allows consumers to sample new music in much the same way as they can with free file-trading networks, without having to pay for each song. While the subscription model was slow to pick up customers, it has begun to gain more customers as record labels have allowed more music to flow into the plans and have permitted CD burning and similar features. The per-song charge model allows users to purchase a song at minimum cost via on-line music stores. Many users, however, regard the subscription fee or the per song fee of these music download services as too expensive. Additionally, using the services can be inconvenient and cumbersome to use.

Apple Computer provides an iTunes Music Store service, which offers per-song downloads from five major record companies at a relatively nominal cost per track, without requiring a monthly subscription fee as other services do. While the cost per song is more desirable than other digital music services, the iTunes Music Store has a limited music collection with its current major-label only representation, as well as a lack of community building functions, and no affiliate program.

The other digital music services such as Pressplay, MusicNet, Rhapsody, MusicMatchMX, and eMusic, among others are cumbersome to use and require users to spend a significant amount of time to search for and select content to download, as well as to oversee download and storage of content that may be corrupted and require repeated attempts to download. Further, they also have limited song lists. A need therefore exists for a digital music service that facilitates access to and authorized downloading from different digital music collections to provide an optimal variety of song titles.

Apple Computer's iTunes model only allows 30 seconds of preview and is only for its limited library of songs available for purchase and download. Furthermore, the iTunes Music Store does not provide a programming service, by which users experience a continuous broadcast of music selected by the programmer, that can be listened to anywhere. Even with a selection of "internet radio" streams, the iTunes Music Store requires a user to be connected to the internet, and does not facilitate user purchases based on music they hear in an internet radio stream. A further need therefore exists for a more complete preview of songs before purchase and download, and for improved navigation through music collections to select songs for downloading. A need also exits for a more comprehensive preview function in conjunction with a larger library of downloadable music.

Car audio products are also very popular, the most common being multi-disc CD players that hold on the order of 6 to 10 discs. Typically, the multi-disc CD players require a cartridge to be loaded into the player and the user selects the disc to be loaded into the cartridge, as well as a disc and track to be played. The location of the CD player is usually in a car trunk or under a seat, which makes it inconvenient to switch discs. Also, the user is always limited to the number of CDs they want to keep in their car and having to repeatedly remove and replace discs to have fresh content. Finally, after the novelty wears off, the same discs remain in the CD player and the user listens to stale content. A similar problem exists with conventional MP3 players. If the user does not take the effort to load the player with new content, they eventually stop using the device because it has the same stale content. Even with hard-drive based devices such as the Apple iPod, which can store thousands of songs, the songs are limited to the user's personal library of music. In other words, there is no existing way to automatically or easily update the users library with new music. The user is eventually stuck with either a library which becomes stale over time, or with taking the time and effort to update and manage their personal library of digital media.

Also, satellite radio receivers that work with existing subscription services such as that of XM Satellite Radio, Inc. are advantageous in that they provide users with a continuous stream of diverse, spontaneous content delivered in channels organized by cartegory. However, even these players are limited in that the live signal is not available everywhere. For example, a user in a car may experience an outage inside a tunnel, or a user of a portable, wearable receiver may not be able to receive the satellite or terrestrial rebroadcast signal inside their local gym. Therefore, a need exists for a satellite radio receiver which stores satellite broadcast content for time-shifted playback when a live signal is not available Additionally, as compression algorithms and hardware designs advance, the ability to receive video signals anywhere will be possible. With these technological advances, the consumer desire for video content will be high. It should be understood that while reference is made herein to digital music for exemplary purposes, it should be understood that the concepts of the present invention can be applied to video and other digital media as well.

SUMMARY OF THE INVENTION

In accordance with an aspect of the present invention, a recording and playback device is provided that operates with a broadcast content source to give users a spontaneous and diverse media experience from which to locate, select and record content for playback, including the authorized acquisition or purchase thereof for permanent storage.

In accordance with another aspect of the present invention, a recording and playback device is operable in conjunction with a broadcast content service such as an SDARS system to playback previously stored time-shifted content when the live broadcast signal is unavailable. Additionally, the personal recording device is capable of storing content for playback at a later time and at the user's convenience.

In accordance with another aspect of the present invention, a content preview service is provided whereby a stream of content is available to users for a temporary period of time for one-time play, multiple-time play or storage. Although, the following description relates to music, a similar service would be available for video content, news, talk show and any content that can be broadcast. The songs in the stream of content are preselected, as opposed to on-demand media services that provide content in response to a user request. The user can navigate and selectively listen to the songs in the stream and select song titles for purchase and authorized, permanent storage. The music preview service is preferably only temporarily stored, and is not downloadable, tradable or otherwise transferable without authorization.

In accordance with another aspect of the present invention, the songs in the preview stream are preferably stored in a database that also stores information relating to online vendors from which the respective songs can be purchased and downloaded. An application program is provided to the user for use with any device to facilitate preview song navigation, selection and purchase via one of the online vendors based on the selected song and its corresponding identification code and vendor information in the database.

In accordance with yet another aspect of the present invention, a device is provided which has memory for temporarily storing a stream of broadcast content comprising a plurality of songs and related information such as artist and title. The portable device can be connected to a computer with a user application program to facilitate navigation, selection, purchase and downloading of songs previewed in the temporarily stored content.

In accordance with still yet another aspect of the present invention, a device is provided which has nonvolatile memory for authorized storage of songs. The device can be used to temporarily store time-shifted broadcast content. Once song selections and purchases are made via the user application program, the songs can be permanently saved on the device for unlimited playback In an embodiment of the present invention, the user may instantly purchase the desired content without having to spend unnecessary time searching for the content because the user does not know the unique identifier for the content.

In accordance with another aspect of the present invention, the user's computer or other device for on-line music previewing and downloading is provided with a user application to facilitate navigation of Program Associated Data (PAD). PAD is ancillary data broadcast with the temporarily stored media that relates to the content, such as the song titles, artists' names, music genre, broadcast channel number and so on. The application further facilitates acquisition of a permanent copy of the media from the vendor of that song. PAD data is synchronized with file transmission to facilitate the navigation of files stored in the device (either temporarily or permanently).

As stated above, the library of content available for temporary storage and preview from XM Satellite Radio is extensive. The XM Satellite Radio music collection is continually growing and consists of approximately 2 million songs at the present time. The variety of music and music channels being broadcast continuously via the XM Satellite Radio Inc. service is a top-selling point for its expanding subscriber base. As described in more detail below, the user application can allow the user to create different types of lists from temporarily stored content (e.g., arrange songs by artist, interviews by a specific host) which can help with selection of titles for acquisition purposes.

In accordance with another aspect of the present invention, a device is provided for receiving, storing and playing back a satellite broadcast signal. As described in more detail below, the device enables a user to record at least one channel from the satellite broadcast stream for a selected period of time temporarily. The device also has features that allow it to comply with data rights management issues, and to store content permanently if the user is authorized to do so, such as, for example, by purchasing content.

The database of music at XM Satellite Radio generally includes unique identifiers for each song title, among other information. In accordance with another aspect of the present invention, vendor information is stored for each song title. A user application, in turn, facilitates a transaction with the database whereby a user request to acquire one of the songs in the stored preview stream is processed to route or map the request to the appropriate purchase option (such as from a particular online music download service provider, from a recording company, ASCAP, and so on). The user download request interface is particularly valuable in view of the wide variety of content available on XM Satellite Radio including music from unsigned bands, that is, song titles not available from one of the major recording companies. A user can acquire any of these preview songs from XM Satellite Radio or an affiliated vendor because of agreements with the artists featured on this unique channel. Thus, the artists benefit from the increased exposure and sales channel, and the download users benefit from an increased selection of music that would not otherwise be available for downloading.

BRIEF DESCRIPTION OF THE DRAWINGS

These and other aspects, advantages and novel features of the present invention will be readily comprehended from the following detailed description when read in conjunction with the accompanying drawings.

DETAILED DESCRIPTION OF THE PREFERRED EMBODIMENTS

In one embodiment of the present invention, a device is provided for use in conjunction with a satellite digital audio radio service (SDARS) broadcast stream such as that of XM Satellite Radio Inc., of Washington, D.C. A broadcast stream that provides such a service (SDARS) can have on the order of hundreds of different program channels to transmit different types of music programs (e.g., jazz, classical, rock, religious, country, and so on) and news programs (e.g., regional, national, political, financial and sports). The SDARS can also provide emergency information, travel advisory information, educational programs, and the like. The device can also be used with other content distribution systems (e.g., the Internet, or a wireless network different from the satellite broadcast system for SDARS). A wearable or portable player is referred to throughout the specification and is intended only to be an exemplary embodiment of the features of the invention.

A satellite broadcast stream for use with a device will now be described in further detail, followed by a description of the components of exemplary players. For illustrative purposes, the SDARS provided by XM Satellite Radio will be described herein. It is to be understood, however, that the bit stream processed by the wearable player of the present invention can also be a broadcast transmitted by other means, such as via terrestrial FM stations, as well as a digital content stream transmitted via a network such as the internet.

Figure 1:
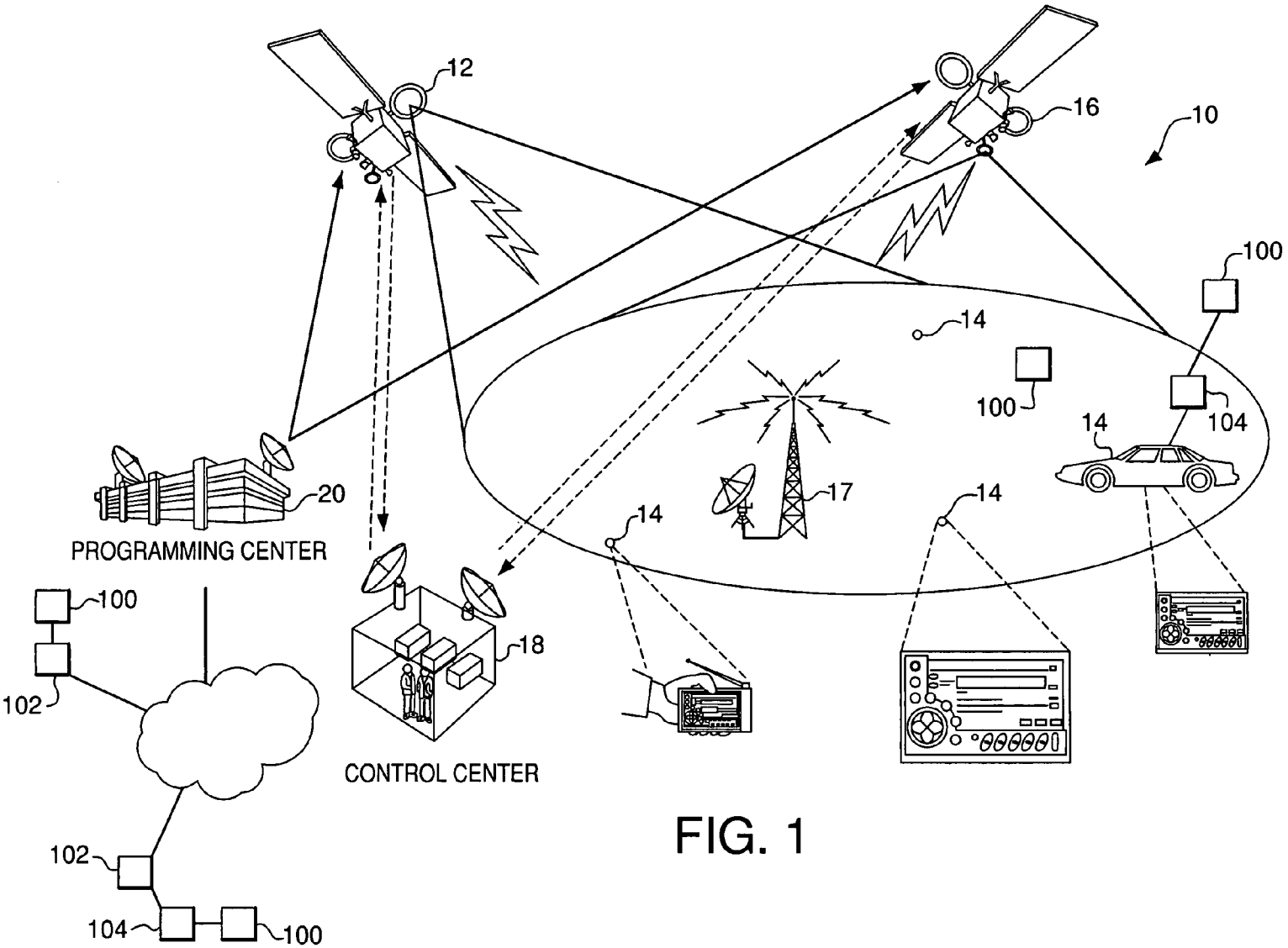
FIG. 1 illustrates a satellite broadcast radio system in which a device or method implemented in accordance with an embodiment of the present invention can be employed.

An exemplary satellite broadcast system in which a device according to an embodiment of the present invention can be used will now be described. FIG. 1 depicts a satellite broadcast system 10 which comprises at least one geostationary satellite 12, for example, for line of sight (LOS) satellite signal reception at receiver units indicated generally at 14. The satellite broadcast system 10 can be used for SDARS, for example. Another geostationary satellite 16 at a different orbital position is provided for diversity purposes. One or more terrestrial repeaters 17 can be provided to repeat satellite signals from one of the satellites in geographic areas where LOS reception is obscured by tall buildings, hills and other obstructions. It is to be understood that different numbers of satellites can be used, and that satellites in other types of orbits can be used.

As illustrated in FIG. 1, a receiver unit 14 can be configured for stationary use (e.g., on a subscriber's premises), or mobile use (e.g., portable use or mobile use in a vehicle), or both. In accordance with the present invention, a device 100 is provided that is a portable type of receiver unit 14, and is operable with a home or car device docking station 104. A control center 18 is provided for telemetry, tracking and control of the satellites 12 and 16. A programming center 20 is provided to generate and transmit a composite data stream comprising a plurality of broadcast channels via the satellites 12 and 16, another broadcast system, or a network such as the Internet. For example, the programming center provides the composite data stream, or at least a portion thereof, to users via the Internet. As will be described in further detail below, a device 100 can connect directly to a personal computer 102 via a USB port, or can be operable with a device docking station 104 having a USB port for connection to a personal computer 102, for Internet access capability.

Figure 2:
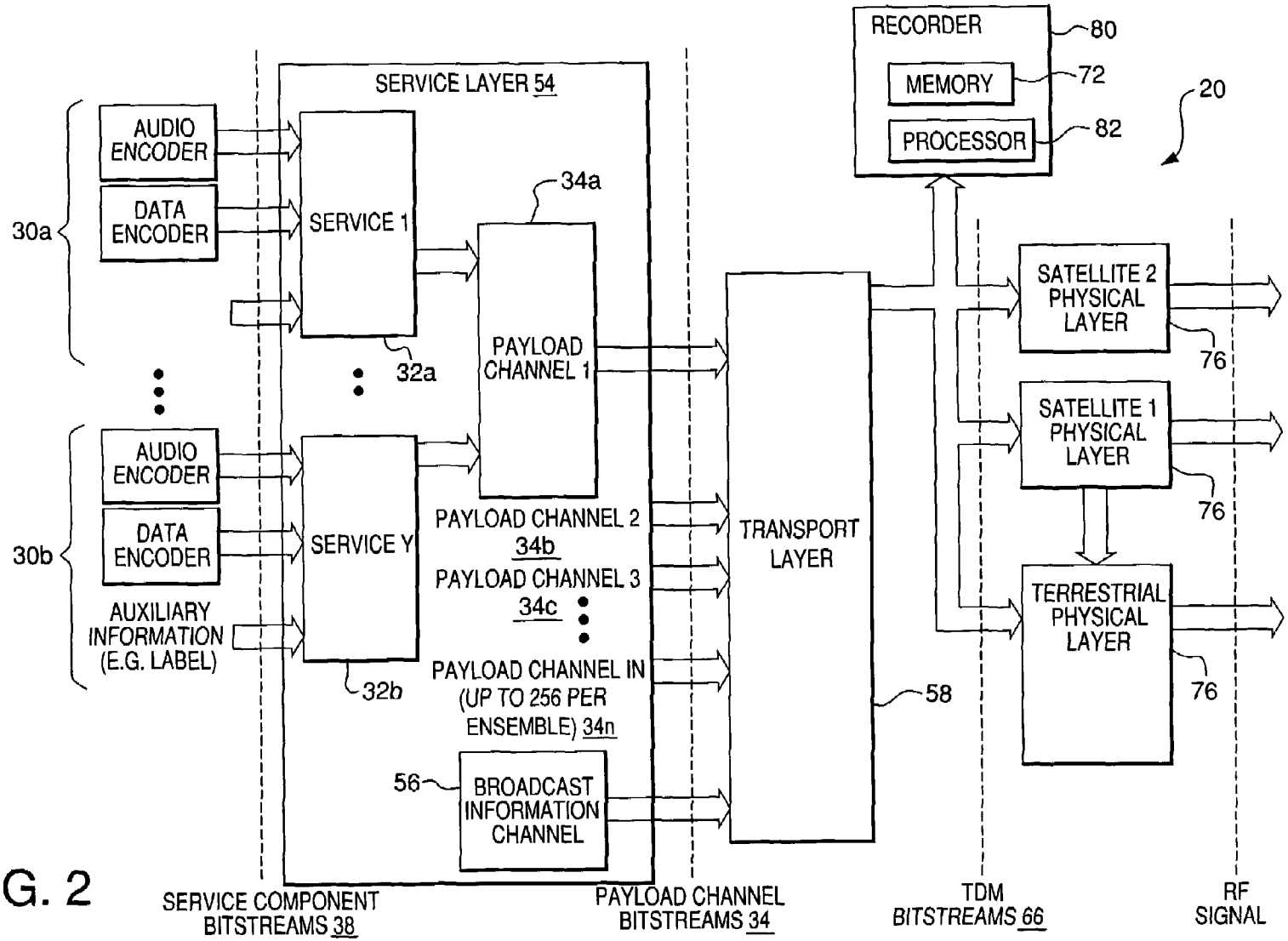
FIG. 2 is a block diagram depicting the generation of a composite data stream for broadcast and recording onto a storage medium in accordance with an embodiment of the present invention.

The plurality of broadcast channels will now be described with reference to FIGS. 2 through 8. With reference to FIG. 2, the programming center 20 is configured to obtain content from different information sources and providers and to provide the content to corresponding encoders, as indicated at 30*a* and 30*b*. The content can comprise both analog and digital information such as audio, video, data, program label information, auxiliary information, and so on. For example, the programming center 20 can provide SDARS having on the order of 100 different program channels to transmit different types of music programs (e.g., jazz, classical, rock, religious, country, and so on) and news programs (e.g., regional, national, political, financial, sports). The SDARS can also provide emergency information, travel advisory information, educational programs, and the like.

With continued reference to FIG. 2, the types of content to be provided in a broadcast channel is determined manually, or automatically via a computer, based on contractual and financial arrangements with information providers, and demographic and financial decisions determining the types of programming to be provided via the programming center 20. In addition, a broadcast channel can comprise plural service components to provide a plurality of different services, as indicated at 32*a* and 32*b*. Further, a number of service components in a broadcast channel can be related to the same service. For example, service components related to the same service can include an audio component, a video component, and a digital data stream comprising auxiliary information or another audio channel to insert advertising information relating to the audio and video program. The programming center is operable to allocate bandwidth for services 32 to different broadcast channels 34*a*, 34*b*, . . . , 34*n* which are configured to transmit the content. As will be described below, the programming center is also operable to allocate bandwidth in a multiplexed data stream among broadcast channels 34 for broadcast or distribution.

The programming center 20 is also configured to broadcast program content and ancillary information that can be related or unrelated to the broadcast program to one or more receivers. It can be useful to transmit data to the receivers that is not necessarily one of the broadcast programs such as a music program or news program. For example, it may be desirable to send a mobile receiver updated maps or local weather or traffic reports, which the user can review on-demand. As an alternative example, the programming center can transmit data such as moderator or announcer name and program or show name in connection with the broadcast of a talk show. In any event, the library of content available for selection and storage in a wearable player via an SDARS broadcast stream (e.g., as generated by XM Satellite Radio Inc.) is substantially larger than the libraries of content offered by existing digital music download services for use with MP3 players.

Figure 3:
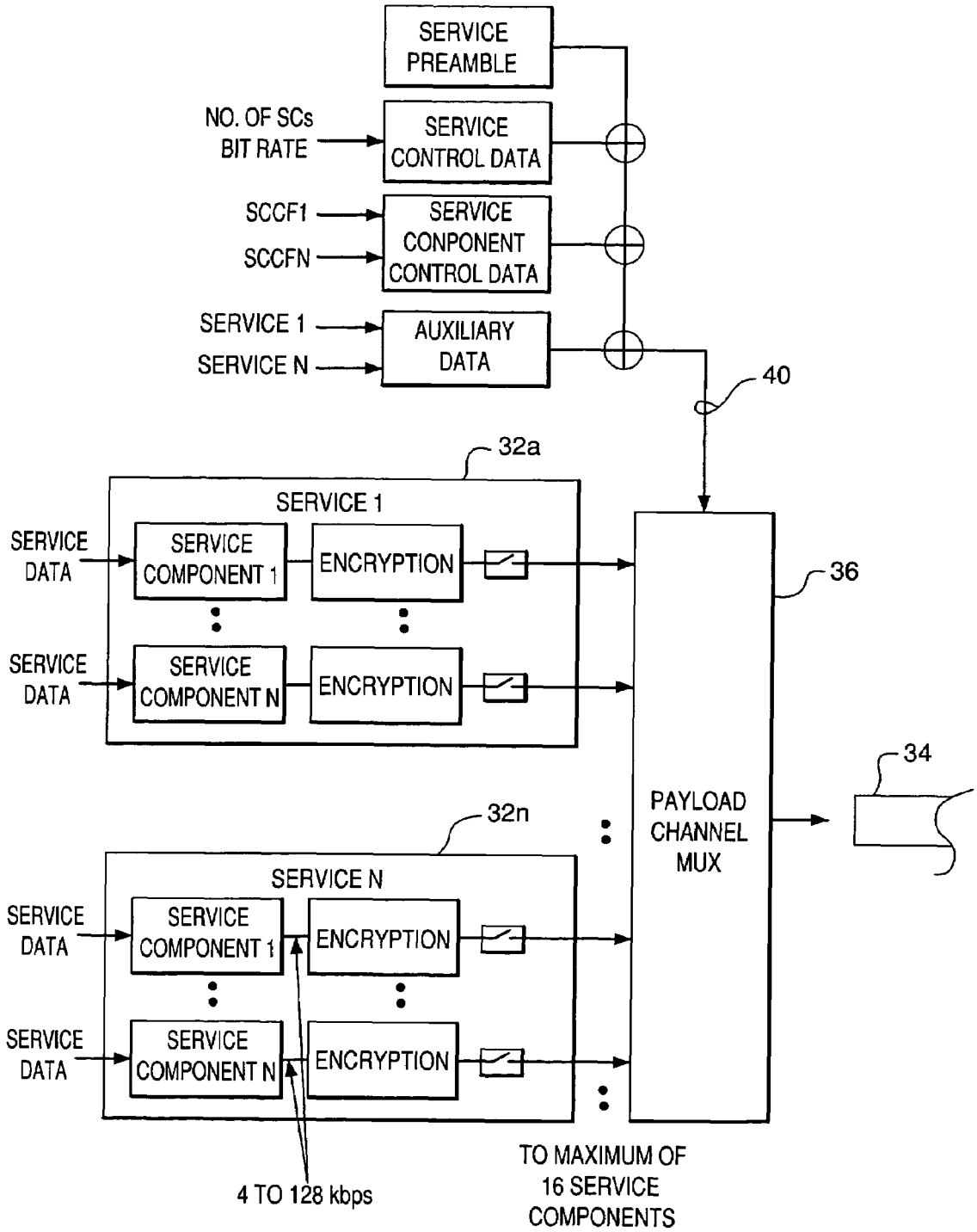
FIG. 3 is a block diagram depicting the conversion of input information into a payload channel in an exemplary satellite radio system in accordance with an embodiment of the present invention.
Figure 4:
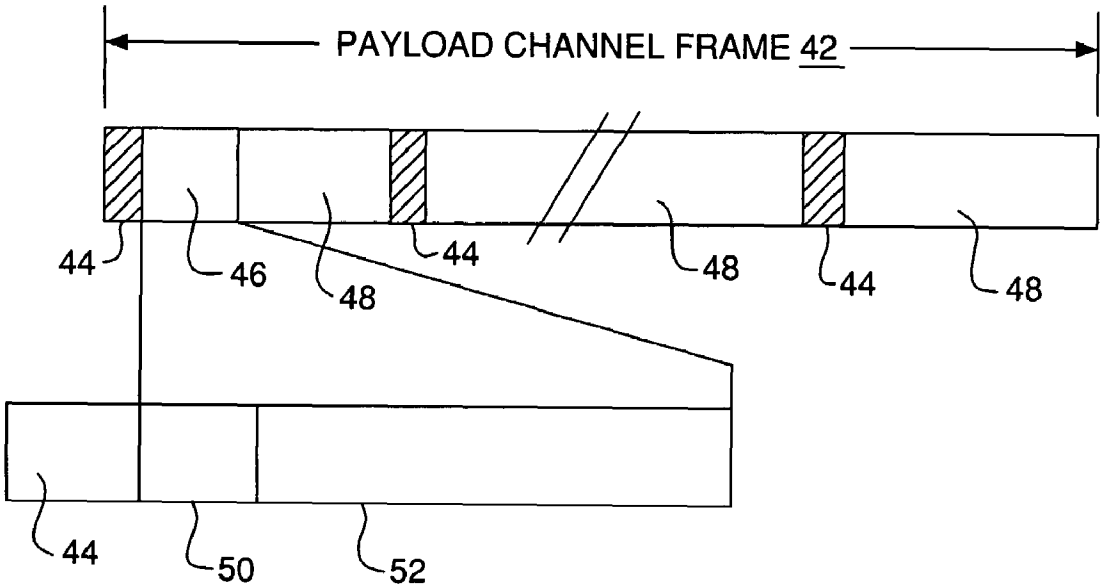
FIG. 4 illustrates a payload channel frame in an exemplary satellite radio system in accordance with an embodiment of the present invention.

With reference to FIG. 3, a broadcast channel 34 is assembled using a broadcast channel multiplexer (MUX) 36. Inputs to the MUX 36 preferably comprise the service components 38*a*, . . . , 38*n* of each service 32*a*, . . . , 32*n* designated by the programming center 20 for transmission via that particular broadcast channel 34. In addition, the MUX 36 receives preambles and other control information, as indicated at 40. A broadcast channel bit stream is preferably organized as frames of a predetermined duration. As shown in FIG. 4, each broadcast channel frame 42 is preferably a time multiplex of preambles 44, a service control header (SCH) 46, and data 48 from service components 38. The preambles 44 are preferably 8 bits and repeated every selected number of bits throughout a broadcast channel frame 42. The SCH comprises bits indicated at 50 which are combined with a preamble 44 to demarcate the beginning of the broadcast channel frame 42. The remaining portion 52 of the SCH comprises data such as the Frame Start ID, the number of service components in the Payload Channel in this frame, a bit rate index, a service component control field (SCCF) for each service component contributing data to the Payload Channel in this frame and an auxiliary data field.

With continued reference to FIG. 2, the generation of broadcast channels, as described above in connection with FIGS. 3 and 4, is one of a class of functions performed by the programming center 20 which are hereinafter collectively referred to as the service layer 54. In addition to generating broadcast channels 34, the programming center 20 multiplexes messages in a broadcast information channel (BIC) 56 in the service layer. The BIC 56 includes auxiliary information useful for services selection and non-real-time control. For example, the BIC 56 can be used control a receiver 14 to switch to a selected channel to receive emergency information. The BIC 56 can also be used to define the relationship of a display channel (e.g., a channel number to be displayed at a receiver 14 or other playback device 100) to the location of the corresponding program in the composite data stream. The BIC 56 can also be used to display the station name of available services, a directory to the contents of the composite data stream, as well as the artist name, song title and program type of the services available in the composite data stream.

Figure 5:
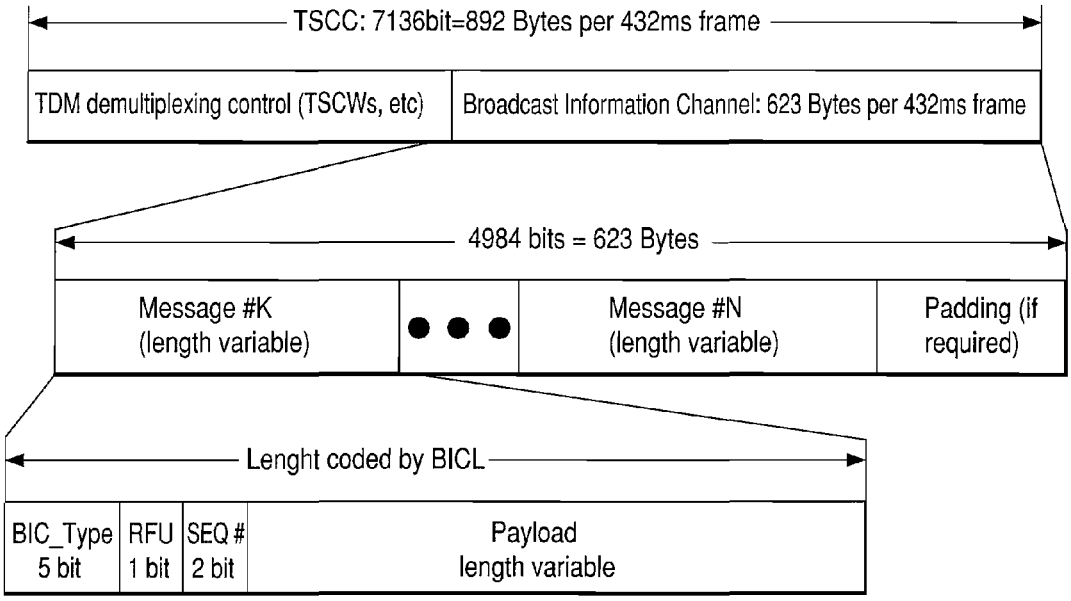
FIG. 5 describes the data that makes up the time slot control channel (TSCC) of a SDARS data stream in accordance with an embodiment of the present invention.
Figure 6:
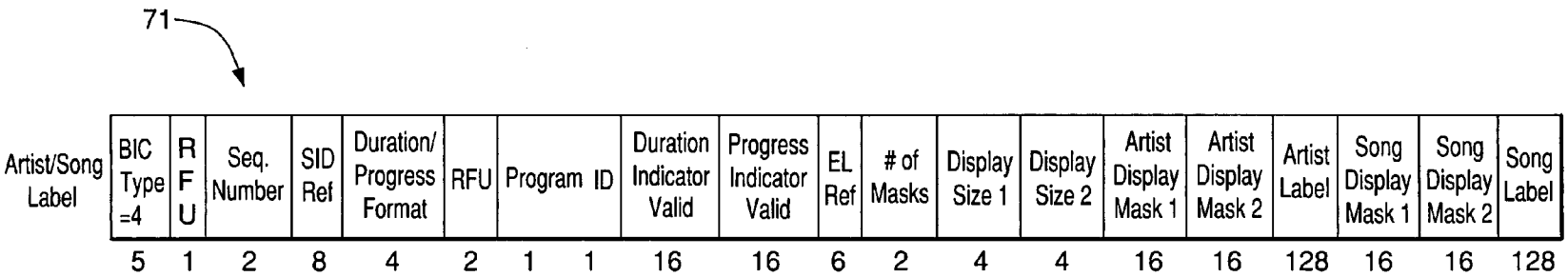
FIG. 6 illustrates an exemplary message employed in the BIC in accordance with an embodiment of the present invention.
Figure 7:
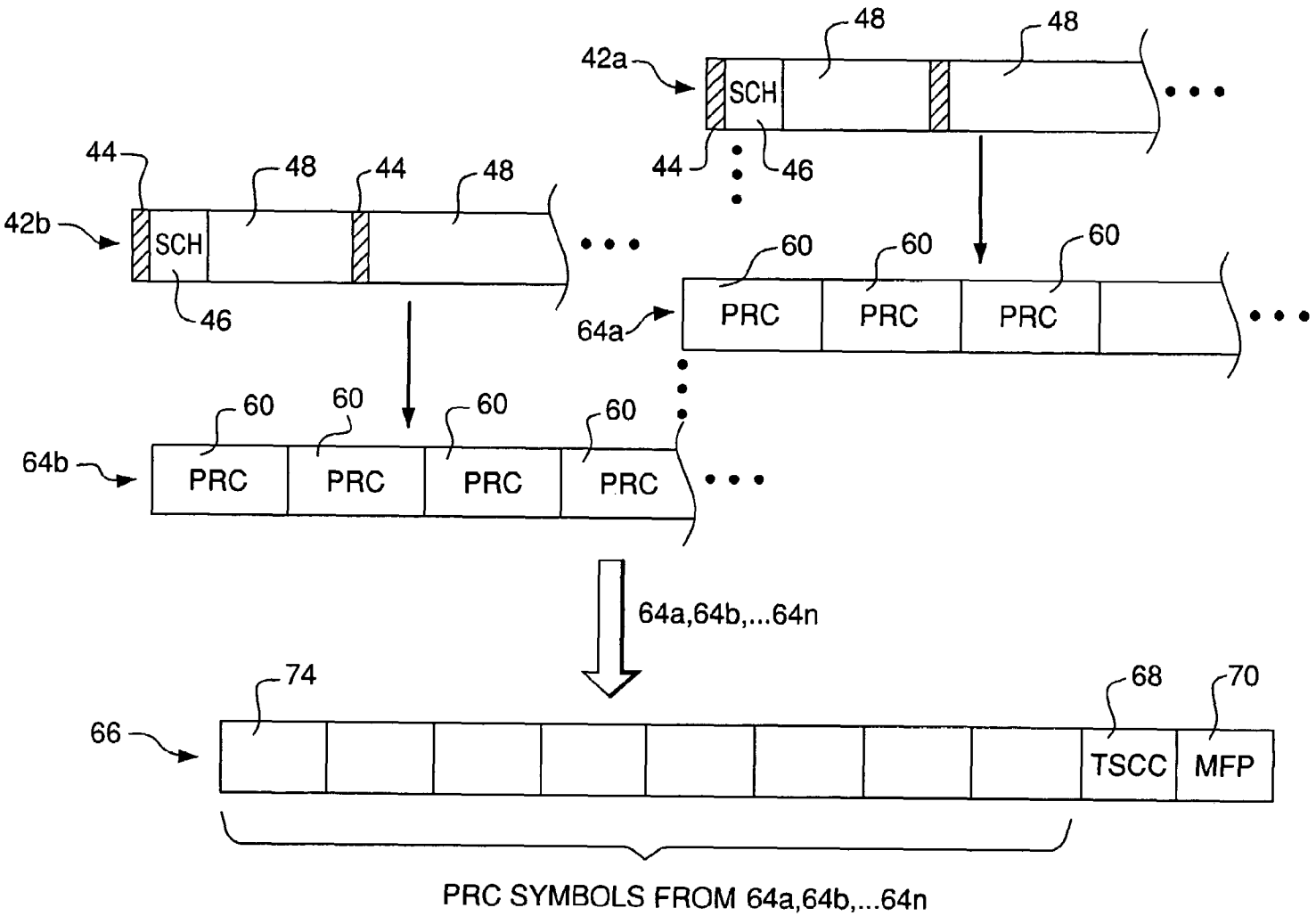
FIG. 7 illustrates assembly of an exemplary composite data stream in accordance with an embodiment of the present invention.

The programming center 20 generates a composite data stream, which comprises a multiplex of broadcast channels and information for demultiplexing the broadcast channels, using a number of operations that are collectively referred to as the transport layer 58 in FIG. 2. FIGS. 5, 6, and 7 illustrate aspects of an exemplary SDARS signal that facilitate authorized acquisition of media content, such as music, for example. The transport layer will now be described with reference to FIG. 7. Each broadcast channel 34 comprising a series of frames 42*a* . . . 42*n* is preferably divided into prime rate channels (PRCs) 60, as indicated at 64*a* . . . 64*n*. Each PRC 60 comprises a selected number of bits. The programming center 20 uses PRCs 60 from different broadcast channels 34 to generate a composite data stream 66. The number of PRCs provided to the data stream 66 depends on the desired bit rate of the service to which the PRCs belong.

The program content and ancillary data to be transmitted via the digital broadcast system is formatted at the programming center, broadcast station or other device in the transmit segment of the system for transmission as a composite data stream. The formatting allows for transmission of the composite data stream in 432 ms frames, where each frame is subdivided into multiple 8 kbps prime rate channels (PRCs). Each program content stream is assigned to a predetermined number of prime rate channels, in accordance with the bandwidth requirements of the program content. The multitude of program content streams with associated prime rate channels are multiplexed together in each 432 ms frame. A continuous sequence of 432 ms frames comprise the composite data stream, as described in commonly-assigned U.S. Pat. No. 6,564,003 which is incorporated by reference herein, thereby reducing the demand on the instantaneous bandwidth of the system. The streams of program content are provided with headers in each frame to facilitate their capture in a local storage device at the receivers. The baseband data stream can then be modulated and multiplexed as needed for transmission via a composite data stream.

With continued reference to FIG. 7, the broadcast or payload channels 34 are so named since they are broadcast via satellite in the illustrated embodiment. It is to be understood that the payload channels can be distributed by other methods such as other signal transmission methods and, as described below in accordance with an embodiment of the present invention, via the distribution of storage media having payload channels 34 stored thereon or a multi-point network. In accordance with a preferred embodiment of the present invention, the composite data stream 66 is a time division multiplexed (TDM) ensemble comprising parts of different broadcast channels 34 (e.g., PRCs 60 or PRC symbols), as indicated at 64*a* and 64*b*, arranged in time slots 74, a time slot control channel (TSCC) 68, and a master frame preamble (MFP) 70. As shown in FIG. 5, the TSCC 68 is comprised of TDM demultiplexing control information and a Broadcast Information Channel (BIC) 56. As will be described below, the TSCC 68 is useful to demultiplex the PRCs 60 to their respective broadcast channels 34 at a satellite receiver 14, or at a playback device (FIG. 9) configured in accordance with an embodiment of the present invention to extract and playback selected information from a composite data stream 66 stored on a storage medium 72, as shown in FIG. 2. It is to be understood, however, that PRCs 60 from different broadcast channels 34 can be multiplexed using different techniques such as frequency division multiplexing.

Figure 8:
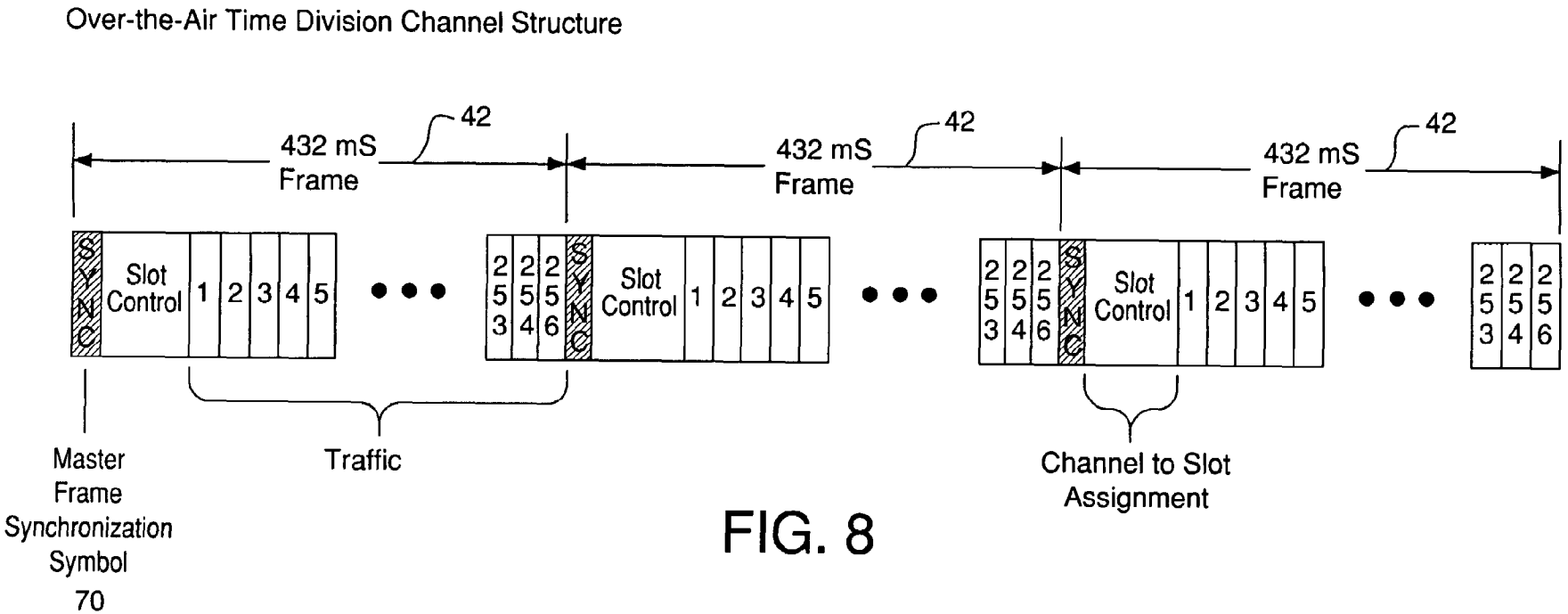
FIG. 8 illustrates the Over-the-Air Time Division Channel Structure of an exemplary SDARS in accordance with an embodiment of the present invention.

The MFP 70 in the composite signal 66 allows for synchronization at the receiver 14. The TSCC 68 comprises TDM structure information (e.g., a broadcast channel-to-PRC-to-time slot assignment table) to indicate which time slots 74 in the composite signal 66 comprise symbols from which PRCs 60 or payload channels 34. The TDM structure information can be arranged in the TSCC as a number of time slot control words (TSCWs) corresponding to each PRC in the composite data stream 66. Each TSCW can consist of a selected number of bits to provide such data as a broadcast channel identification number (BCID), which identifies the location of a broadcast channel in the composite data stream 66. The TSCC can also comprise time and date fields and the BIC 56 described above. As shown in FIG. 8, the transmitted data stream is preferably time division multiplexed (TDM) in 432 millisecond (ms) frames 42. The TDM frames have preambles in which framing information is provided. For example, a master frame synchronization symbol 70 comprising a master frame preamble (MFP) and a fast synchronization preamble (FSP) can be provided for synchronization of the TDM frames. A time slot control channel (TSCC) 68 can also be provided in the preamble which comprises information such as a frame counter and data indicating which time slots contain data from which sources. The remainder of each 432 ms frame 42 preferably comprises PRCs 60.

With reference to FIG. 5, an exemplary TSCC 68 is multiplexed with the BIC 56 in accordance with an embodiment of the present invention. The BIC 56 preferably comprises messages 71 that correspond to different payload channels 34. An exemplary message 71 comprising Program Associated Data (PAD) is depicted in FIG. 6. PAD can comprise data associated with a channel such as a song name or label, artist name or label, service ID (SID), and program ID, among other data. The service ID is an identifier (typically 8 bits) which is associated with a specific XM Satellite radio service (such as Top Tracks, CNN News, The Comedy Channel, and the like) and is used by the service layer of the system to identify the specific stream containing the service at the receivers. The program ID comprises data relating to the duration and progress of a song, for example. The messages 71 can have different formats and functions than that depicted in FIG. 6. Further, the timing of messages 71 in relating to a particular channel can vary according to the needs of the service provider and to bandwidth requirements. In other words, a message 71 need not be provided for all of the respective channels in every transmitted frame of the content stream 66.

With continued reference to FIGS. 2 and 7, the transport layer 58 can also employ additional processing of the TDM data stream such as inner forward error correction (FEC) encoding (e.g., convolutional encoding and puncturing) and interleaving. The physical layers 76 in FIG. 2 for the satellite and terrestrial signals comprises programming center 20 functions such as modulating the composite data stream (e.g., QPSK modulation) and otherwise preparing the data stream for signal transmission.

There will be times when the live signal is unavailable or of poor quality due to a number of conditions. If the user is in an urban setting buildings may create valleys where the live signal (e.g., the XM broadcast signal) is unavailable or intermittent, even with terrestrial signal repeaters. Additionally, the quality of the signal may not be high enough for the device to allow the user to hear the degraded signal.

A device 100 according to an embodiment of the present invention allows a user to store content from other sources, record content that is broadcast for subsequent use, and also facilitates the purchase of content from a content provider.

The device 100 according to an embodiment of the invention has a plurality of memory types which perform various functions to store content with varying degrees of user control. The memory types may include either volatile or non-volatile memory, or both. Furthermore, it should be understood that in the following descriptions of memory devices, they may be fabricated in different partitions of a single physical memory device. The different types of memory allow the device to provide functionality according to different levels of authorization, while still allowing the user to manage content that they own or are authorized to use in a particular manner. The user may partition the memory for specific purposes; however, the device also may partition the memory as will be described in further detail below. The device 100 performs some recording functions automatically and requires memory, so some memory will be inaccessible to the user. Other recording functions are optional based on the features selected by the user.

A device 100 according to an embodiment of the present invention generally has at least three segments of memory. A first memory is referred to generally as a temporary memory, and is preferably a volatile memory that is erased whenever the device is powered down. The temporary memory will be described in more detail below, but generally is used to store broadcast content as the user listens to a live broadcast. In this way, a user has the ability to pause, rewind, skip forward or backward, and fast forward through a live broadcast. The temporary memory preferably stores the last 30 minutes or so of live broadcast content, although the specific amount will depend on a number of factors, including the hardware limitations of the particular device.

A second type of memory is non-volatile limited control memory. The non-volatile limited control memory is used to store broadcast content for longer durations than the temporary memory, but still not provide full control to the user. Thus, for instance, content that the user likes may be transferred to the non-volatile limited control memory so that it will be available even after the device is powered down. Alternately, several hours of broadcast content from a user's favorite channel may be stored overnight in the non-volatile limited control memory overnight while the device is recharging. In a preferred embodiment of the device, a controller determines when to erase or overwrite content stored in the non-volatile limited control memory. Also, preferably, content stored in the non-volatile memory is not available to be transferred out of the non-volatile limited control memory without authorization, such as by purchasing content, for instance.

A third type of memory is non-volatile personal memory. This type of memory is preferably designed to store content that the user has substantially full control over. Thus, for instance, music that is purchased by the user can be stored in the personal memory to be enjoyed in a substantially unlimited way.

The device 100 will receive broadcast content from which the user can select content to purchase. As described above, the broadcast content includes both payload data (the song file) as well as PAD data that is related to the particular song. The device 100 preferably stores both the payload and PAD data from the broadcast content. The device 100 also includes an interface that allows the user the "buy" content that they hear in the broadcast stream. So, for example, during playback of a particular song, the user can press a "buy button". The "buy button" would in turn perform some action based on the PAD data associated with the selected song. The device 100 may be programmed to store the PAD data in order to later retrieve a downloadable, high quality version of the song identified in the PAD data. The PAD data further preferably includes vendor specific information for that song or information cross-reference to the specific content to a particular vendor. So, for instance, when the user presses the "buy button" during playback of a particular song, the device 100 can use the vendor specific information in the PAD data to retrieve a downloadable version of the song from the vendor for that particular song. Alternately, the "buy button" may perform a different function. For example, the "buy button" may cause the device 100 to store the payload of a particular song in non-volatile memory, perform a quality metric to ensure that there were no mutes during reception of the song, and then transfer the song to the user's personal memory for permanent storage. The device 100 preferably connects to an external network, such as the Internet or a cellular network though a personal computer or a cellular phone. Information on the buy button purchase can be uploaded to the vendor or service provider for billing purposes. In another embodiment which downloads high quality versions of purchased songs, the device 100 can be connected to a PC to retrieve the purchased file over the Internet from the appropriate vendor. Or the device 100 could be connected to, or incorporated into, a cellular phone, and download the purchased file over the cellular network.

Any description herein is applicable to any type of device 100 that receives the XM broadcast signal. While a preferred embodiment is described herein as a wearable, portable player having a form factor similar to today's MP3 players, the device 100 could also be a home audio component, an auto receiver, or a combination device, such as the SKYFi product which can be connected to docking kits designed for the home or an automobile. Furthermore, the devices 100 described herein may include the ability to interface to other devices. So for example, the device 100 may connect to a PC through a USB cable, docking station, or the like. The device 100 may also connect to a cellular phone through a cable, Bluetooth wireless connection, or otherwise. Thus, it should be understood that the concepts described herein may be applied to a wide variety of XM Radio devices in a wide variety of form factors and connectivity options. The embodiments described herein are intended to be exemplary, not limiting.

Figure 9:
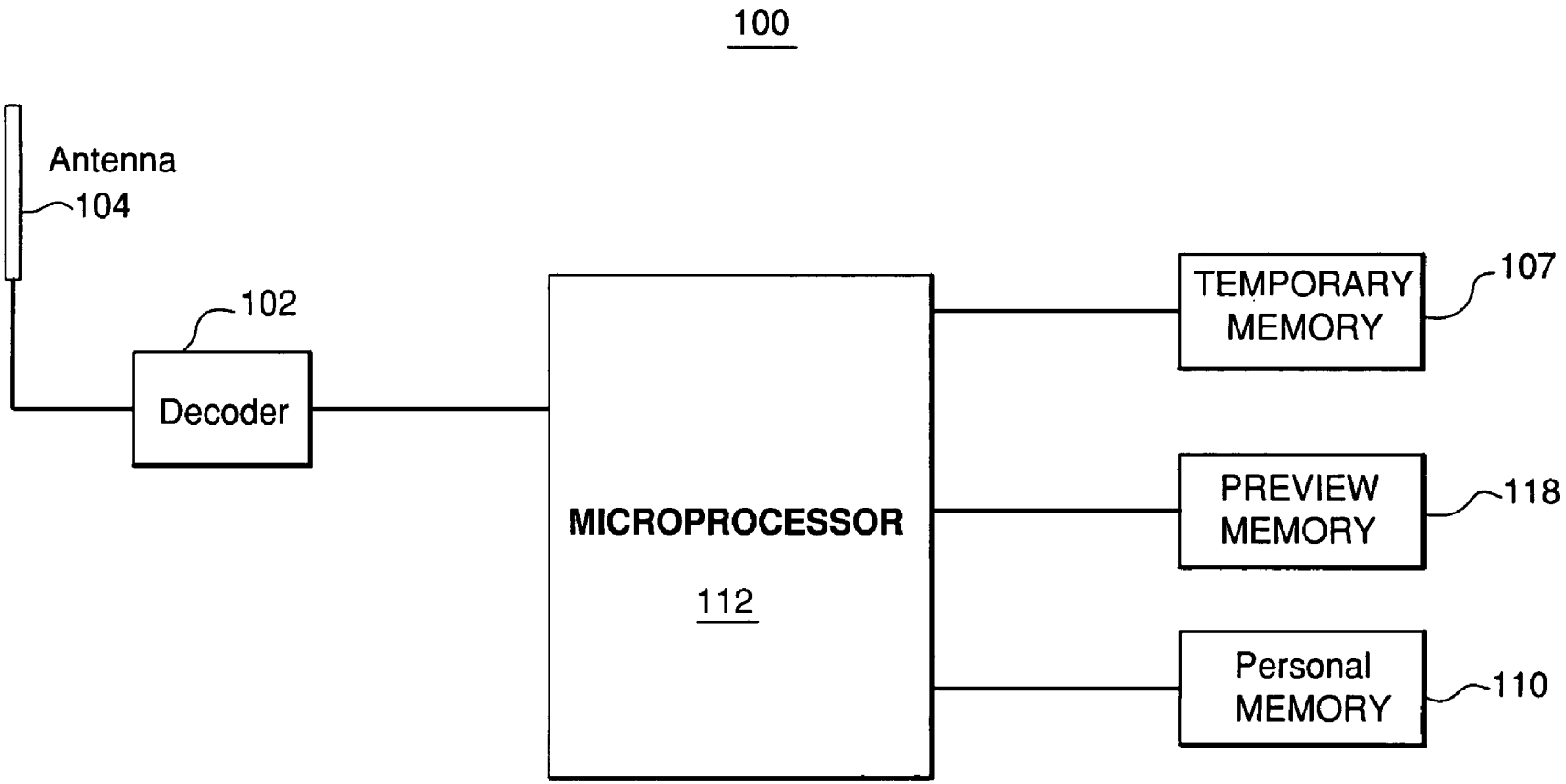
FIG. 9 is a block diagram of an exemplary implementation of memory components in accordance with an embodiment of the present invention.

FIG. 9 is a block diagram of a device 100 according to an embodiment of the invention. It has a Temporary memory 107, Preview memory 118, and a Personal memory 110. Temporary memory 107, preferably volatile memory, is used by the device 100 to store content that will not be stored beyond the user's current listening session, such as content stored during Playback mode. Preview memory 118, preferably non-volatile memory, can be configured into partitions of several tracks by the user as well as still being accessible to the device 100 for Record and autorecord modes. Personal Memory 110 receives data transferred for permanent storage, or until the user deletes the data. Personal Memory 110 may either be fixed or removable. Personal memory 110 is preferably Flash memory or a hard drive. In one embodiment according to the present invention, the data cannot be transferred from fixed personal memory 110.

Exemplary embodiments of the different implementations of memory in the instant invention include two modes: Live Mode and My XM Mode. In the Live Mode, the user is listening to one of the plurality of channels of the broadcast content stream. The Temporary memory 107 will buffer the content from the channel to which the receiver is tuned, if the Playback function is activated.

The device 100 may have volatile memory, as its Temporary memory, in which content may be temporarily buffered. The volatile memory will preferably be erased whenever the device is powered off. The volatile memory preferably buffers live broadcast content as the user listens to it. This function will be referred to herein as the Replay function.

The Replay function allows the user while listening to a live broadcast to control content that they have already listened to. Thus they are able to pause, rewind, and fast forward back to the real time broadcast. They can also skip through tracks stored in the volatile memory based on the PAD data stored along with the content. This allows the user, while listening live, to stop and replay a certain lyric or answer to a question that they may not have understood or that they had liked, without missing the rest of the song or interview. The Replay function then allows the user to continue listening to the buffered content or the user can "fast forward" to the end of the buffer to catch up with the live content. The memory used for the Replay function is preferably volatile memory, but could be implemented using any suitable memory technology.

The Temporary memory also supports the "buy" feature. Thus, a user is able to press a "buy" button while they are listening to live or temporarily buffered content. The device 100 in turn, responds to the user selection to enable a purchase of the selected content. In one embodiment, the device 100 stores PAD data associated with the selected song in a memory location to facilitate a purchase of the song identified by the PAD data. Thus, for instance, PAD data associated with a selected song is stored when the user selects the song for purchase. The PAD data preferably includes song identifying information, such as the name of the song, artist, the name of the CD, or a digital song identifier, and optionally vendor specific information. Later, the user connects the device to a PC, and a software application on the PC retrieves the PAD data stored in the device for any songs selected by the user for purchase. The software application allows the user to view a list of selected songs and their related data. The user can preferably sort through the list by artist, song title, or by any other criteria.

The vendor specific data associated with each songs facilitates the user acquiring an authorized copy of a particular selected song. Thus, for instance, if a given song is available on the iTunes Music Store, the software application could launch the iTunes application and navigate to the selected song so that the user simply needs to perform a "purchase" action within the iTunes software. Alternatively, the vendor specific information could launch other applications associated with other vendors, including websites or servers affiliated with unsigned bands.

In another embodiment, when the user presses a "buy" button on the device, the processor executes instructions to compile a complete file of the selected song, including temporarily stored content and continues storing the file until the broadcast transmission is complete. Once a complete copy of the file is stored, the file is transferred to a non-volatile personal memory. The device 100 also preferably completes a purchase transaction, such as deducting monetary credits which may be stored at a vendor server location, or locally on the device 100, in order to authorize the purchase and transfer to non-volatile personal memory. In one embodiment, the device is periodically synchronized with the billing system either at the vendors location, through the Internet, or via a cellular network, in order to transfer additional credits and or to report purchased content.

The device 100 also contains a Preview memory, a non-volatile limited control memory that performs a number of functions that will now be described. In one embodiment, the non-volatile limited control memory performs an "auto-record" function, which will be described in further detail below. The auto-record function stores broadcast content, and periodically updates the non-volatile limited control memory with fresh broadcast content. The non-volatile limited control memory preferably is sufficient to store several hours of time-shifted content. In this manner, the user has several hours of fresh broadcast content available in situations when a live signal is not available. The time-shifted content contains PAD data and content data, so that the "buy" function can be performed by the user during playback.

In another embodiment, the device 100 is provided with a record button. During playback of live broadcast content, the user can press the record button to cause the device 100 to begin storing the live broadcast content being played back to the non-volatile limited control memory. The stored recorded content will remain available to the user for playback for some limited amount of time. The amount of time can be based on a number of times the content is played, or an amount of time, or some other criterion that can be calculated. When the content expires, the device 100 erases or overwrites the recorded content. As with the "auto-record" content, the recorded stored content contains ancillary data (PAD data) to facilitate a "purchase" option. Thus, during playback of recorded content, the user can buy content. In one embodiment the purchased song can be transferred from non-volatile limited control memory to the personal memory, once the acquisition has been authorized. In another embodiment, when the "buy" button is pressed, the PAD data associated with the song is stored, and later the song specific and vendor specific information in the PAD data is utilized to facilitate the acquisition of preferably a high quality version of the song file, as described above. As before, after a predetermined period of time or number of plays or transactions, the device must be synchronized with the billing system, the process enables billing for acquired music and compensation for artists and record labels.

The device 100 preferably provides the user with the ability to schedule recordings. Thus, the user may schedule the time, channel, and duration of a recording to capture a particular program. The scheduling function can be implemented by the processor in the device. Alternatively, the scheduling function can be implemented through an external interface, such as an application running on a PC. In that case, the device connects to a PC through a USB interface, docking station, or the like. A software application on the PC then controls the device to schedule a recording according to user selections.

The memory feature has two alternative modes: a Default Mode and a Power Users Mode. In Default mode, pressing the record button causes the receiver to automatically start recording at the point in the memory bank with the oldest content and continue recording until the Record button is pressed again (to stop recording) or until the memory has been completely replaced with new material (it thus automatically "wraps" once and stops). In Power Users mode, an enhanced mode can be activated using the menu for those power users who want the ability to make and manage separate recordings. When selecting this mode in the menu the user chooses between one (the default mode) of two different memory tracks. The receiver automatically clears existing memory and allocates it evenly among the tracks. (Thus, 50% is allocated to each track if two tracks are selected; 33% if three tracks are selected). Pressing the record button causes the receiver to display information for each track including track number, date and time the recording starts (Nov 4), duration (2 hrs 10 mm), and channel number. If there is nothing in a track it shows "Empty". The user then selects one of the tracks and presses the XM Jog Dial in to begin recording the current channel on it. This recording continues until the Record button is pressed again or the memory is full. The user can select other tracks by pressing, for example, the Left or Right arrows. While playing, the display shows all of the standard XM information plus the date (month and day only) and time recorded (hour and minute only), minutes and seconds played and minutes and seconds remaining in memory. If a user leaves a specific track or point in a recording on one track, by switching to a different track for playback, switching to Live mode or shutting the device 100 off, the receiver will preferably set a flag where playback stopped. Thus, the next time that track is chosen for playback, the receiver can begin playback from where it last stopped.

Occasionally, the live signal may fade or fail during a recording. If the device 100 receiver is not getting a signal when Record is started, it will preferably not begin recording but will instead display an error message. Once signal reception is restored and content is again recorded, any mutes or signal outages due to lack of signal availability longer than 2 seconds may be automatically shortened to 2 seconds before playback. This conserves memory space and prevents the user from becoming frustrated with "dead air". In addition, if a mute lasts longer than a predetermined amount, the unit will preferably stop recording and display an error message.

The user can use the following functions during Record and playback: Play/Pause, skip to next song/item, skip to last song/item, skip to next recorded track, skip to last recorded track, or record settings in Menu that allow a user to create up to four tracks and manage tracks by erasing selected tracks selected tracks. In addition during playback the user can preview 2 recorded content and if desired, restart the playback at the beginning of specific content.

Figure 10:
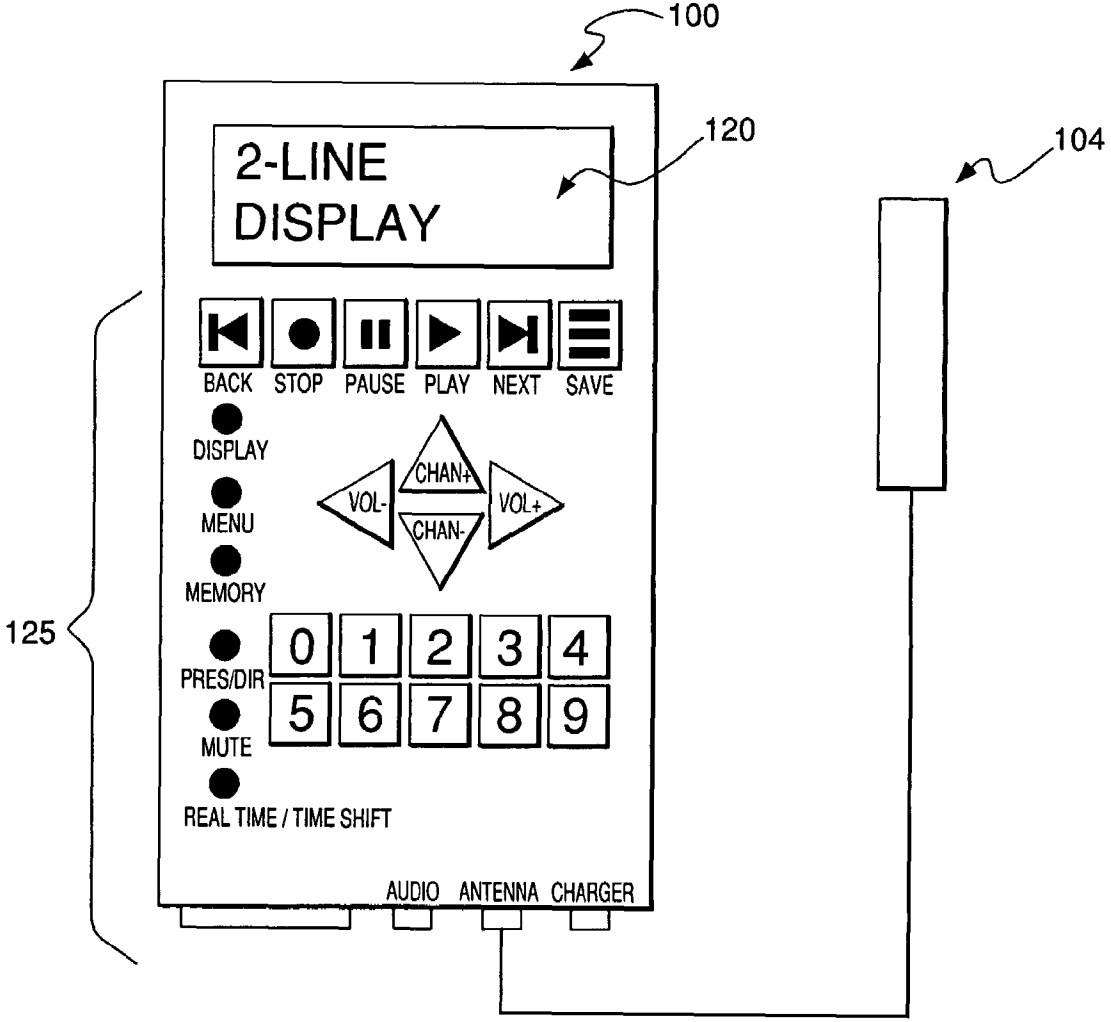
FIG. 10 illustrates an exemplary embodiment of a device in accordance with an embodiment of the present invention.

FIG. 10 shows a device 100 according to an embodiment of the invention with display 120, controls 125 and antenna 104.

Figure 11D:
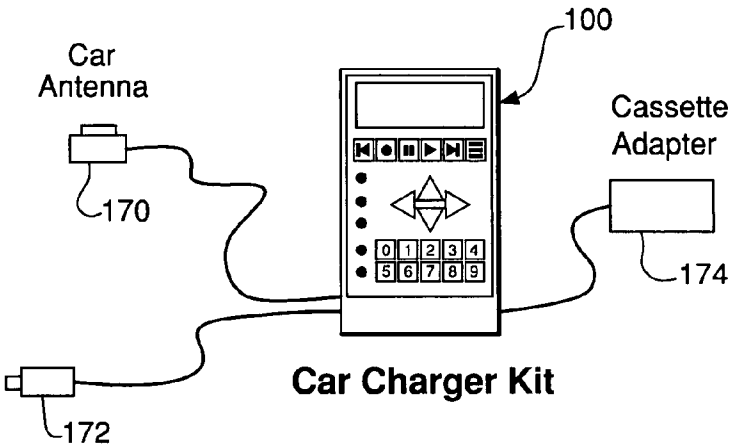
FIGS. 11A, 11B, 11C and 11D show different configurations of a wearable device constructed in accordance with embodiments of the present invention.
Figure 11B:
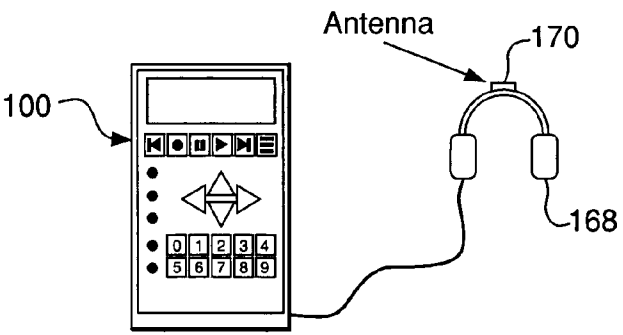
Figure 11A:
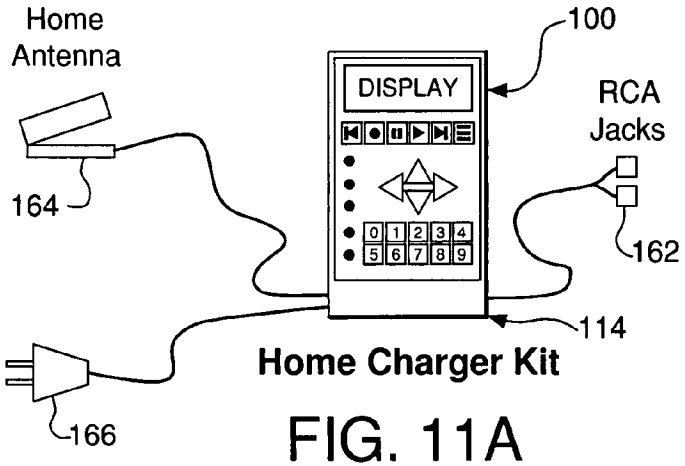
Figure 11C:
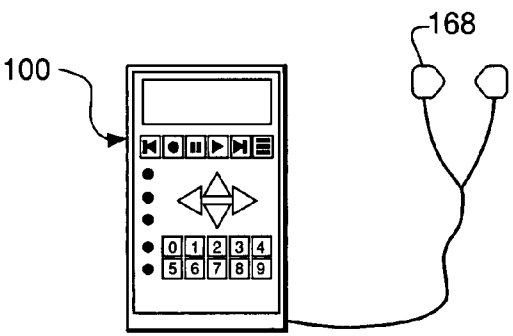

Further embodiments of the present invention provide for different device 100 configurations useable in different locations and for different circumstances. As shown in FIG. 11A, a device dock or home stand 114 for recharging can be provided for use with the wearable player 100 which has a USB connector or port 160 (FIG. 12) and USB cable, internal line level amplifier and ministereo jack 162 for connection to a home stereo, an antenna 164 and power connectors or AC adapter 166. As shown in FIG. 11B, the wearable player 100 can be used alone (i.e., without a device dock or cradle and without power connectors) as a portable device with headphones 168 or ear buds that are preferably combined with an attached or detachable (e.g., clip-on) antenna 170. As shown in FIG. 11C, a player 100' that is only capable of playback and not live SDARS reception can be provided as a less expensive alternative to the player in FIG. 10B that is configured with an SDARS receiver 102 and connectivity to an antenna 104 for live, as well as, playback operation. In addition, the player 100 can be provided in a carrying case with belt clip. An AC adapter 166 can be used that plugs into both the player 100 to recharge the battery thereof, and the home stand 114. As shown in FIG. 11D, a car kit can be provided for using the player 100 in a car. The car kit can comprise, for example, a car antenna 170 and cigarette lighter adaptor 172 for power, and a cassette adapter 174 or other type of adapter or FM modulator. The player 100 can also be configured to operate with, but not include, SDARS single arm car and home antennas.

Figure 12:
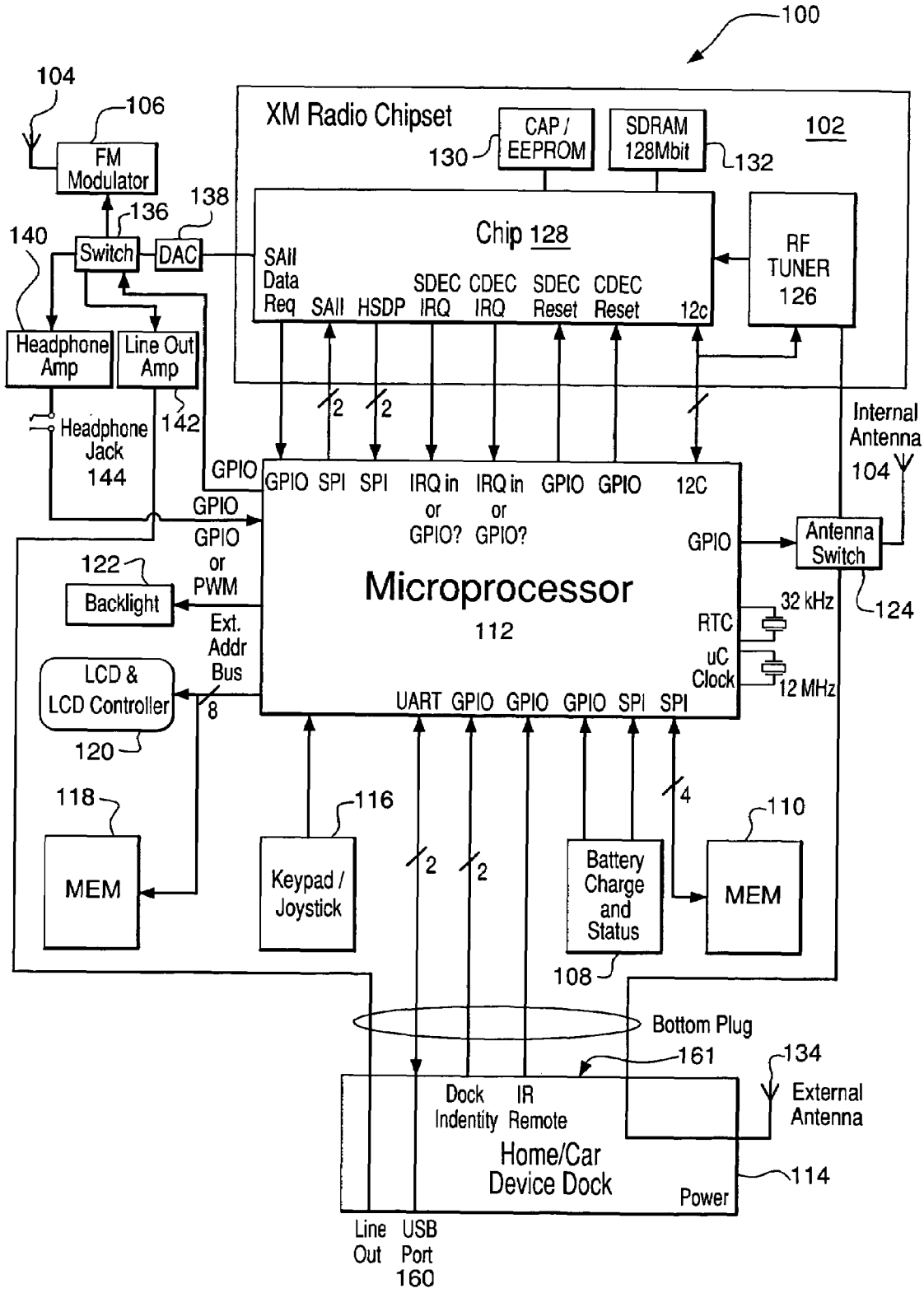
FIG. 12 is a block diagram of an exemplary implementation of memory components in accordance with an embodiment of the present invention.

As will be described in more detail below in connection with FIG. 12, the player 100 preferably comprises a portable SDARS receiver 102 with integrated antenna 104, a wireless FM modulator 106, an internal and replaceable battery 108, and memory device (e.g., an internal memory 110 such as Flash memory and an external memory 118 such as a RAM). The player 100 further comprises an LCD and LCD controller (indicated generally at 120), an input device 116 such as a key pad or joy stick, among other types of input devices), a home or car device dock 114, and a microprocessor 112 for interconnecting the receiver 102, FM modulator 106, battery 108, memory device (e.g., memory 110 and external memory 118, LCD and LCD controller 120, input device 116 and device dock 114. An antenna switch 124 is operated by the microprocessor 112 to select between the integrated antenna 104 and an external antenna 134, depending on whether the player 100 is being used alone as a portable device or with the device dock 114. Another switch 136 is operated by the microprocessor 112 to select between the different output devices (i.e., via headphones (not shown) through a headphone jack 144 and amplifier 140, or via a car or home device dock 114 through a line out amplifier 142, or via the FM modulator 106 and internal antenna 104).

FIGS. 13(A)-(C) illustrate examples of the various ways that the device 100 may be used. In FIG. 13(A), the device 100 is useable with a car dock 104 or by itself with some additional equipment (e.g., FM modulator or cassette adapter). The additional equipment allows the device 100 to broadcast though the car radio or cassette player. In FIG. 13(B), in another embodiment, the device 100 is configured as a handheld or wearable (using a belt clip, etc.) device for use with headphones 145. In another embodiment as shown in FIG. 13(C), the device 100 is shown connecting to a dock 104.

Exemplary embodiments of the different implementations of memory in the instant invention include two modes: Live Mode and My XM Mode. In the Live Mode, the user is listening to one of the plurality of channels of the broadcast content stream. The Temporary memory 107 will buffer the content from the channel to which the receiver is tuned, if the Playback function is activated.

If the user decides to buy a segment of the broadcast content, the content and or content-related information may be stored in the personal memory 103' for later use in purchasing the content. The segment may be a song, interview, recital, video, or other media.

Alternatively, if the user may want to record the content for later enjoyment, the content may be stored in preview memory 118 or personal memory 110 depending upon the user settings for the particular device 100.

In "My XM" mode, the user is listening to the stored content from either temporary memory 107 or personal memory 110. Preview memory 118 may have time-shifted content stored thereon for the user to enjoy or the time-shifted content may be stored in personal memory 110. The personal memory 110 may be a removable memory, such as Flash, on which the user has stored his favorite songs or interviews. The personal memory is preferably a microdrive, but of course any suitable memory device, including hard drives, non-volatile IC type memory, and so on. Alternatively, personal memory may be fixed memory that is accessible via a personal computer or similar device.

Figure 13:
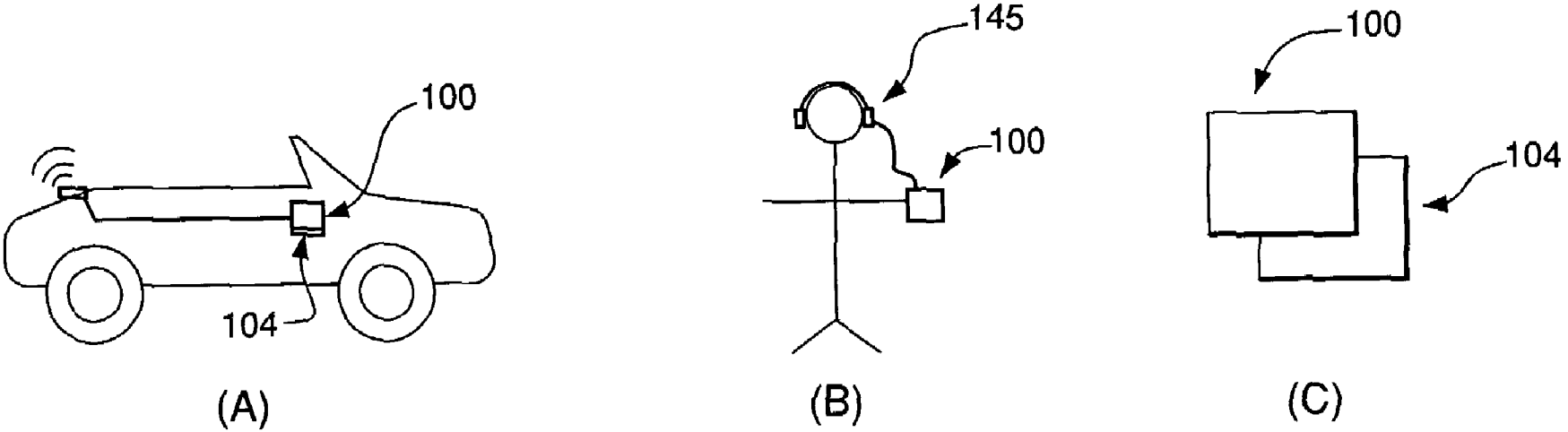
FIG. 13 illustrates exemplary uses for a device constructed in accordance with embodiments of the present invention.

The user or the device 100 may partition the volatile, non-volatile, or personal memories into tracks of memory. The size of the track is based upon the number of tracks and the overall size of the memory. Additionally, the above memories may be formed in a single memory in a device and merely managed as if they were Temporary 107, Preview 118, or Personal 110 memories. Or as shown in FIG. 13, the Temporary 107, Preview 118, and Personal 110 memories may be separate memories in a device 100 or in a combination of devices (a personal computer and device 100 in a dock sharing personal memory). The replay function is also available in MY XM mode.

The device 100 includes the ability to select operation in a real-time or time-shifted mode for playback and optional storage of content. If the wearable player 100 is operated in real-time mode, the user is able to select a channel and listen to the live broadcast. The time-shifted mode allows for playback of previously stored content from the broadcast stream.

If the user has configured multiple tracks of memory, My XM allows the user to navigate between the next track and the previous track. During playback, the XM Jog Dial tuning dial will allow a person to select a different track (if multiple tracks are available) by first "tuning" to it, then pressing in/enter. If only one track is available, the tuning wheel will not function except in menu mode.

Record functions can also be performed on multiple tracks. However, the default is 1 Track. When a person presses the Record button, the unit automatically begins to record the current live broadcast channel into non-volatile memory. If there is recorded content on Track 1, the unit will begin to record at the end of the last recorded content. It will loop around and, if necessary, record over previously recorded content. It will stop recording when it reaches the beginning of the current recording session. If there is a long mute during recording of a predetermined length the unit will preferably not record the mute, but will instead edit from the point when the mute began to the point when a signal returned (an error message can be displayed on the screen at the edit point). When a person plays back the recorded content, an error message will preferably appear at the point when the edit was made. All during the recording session, a person can hear the channel that is being recorded and change channels, jump or scan without leaving the recording mode.

When users must concentrate on another task, they have the option of pausing the device in any mode. Pressing the Pause button mutes the sound in XM Live mode, but the temporary memory buffer continues to fill. A user continues to hear channel while Record is paused in Record mode. Pressing "pause" again restores the sound to the same level it was at when Pause was pressed and the unit starts to play from the point in the buffer when Pause was pressed. Pause also works similarly in MY XM playback mode and continues to play from the point where it was paused and resumes recording in Record mode. The word "Pause" preferably is displayed on the display screen when Pause is active; "Pause" appears when in Live and MY XM modes; and "Pause Record" appears when in Record mode.

The device 100 memory may be accessed by the personal computer when the device 100 is placed in the Home Dock with a PC connection or connected via USB cable. If the device 100 is in a home dock and connected to a computer, PAD data in any memory may be transferred to the computer. In addition, that information and file data in personal memory may be transferred to or from the computer. The file data stored in the temporary memory 107 and the time-shifted content in the preview memory 118 is not transferable to the computer The device 100 has several Memory option functions. One is to store and retrieve Song Info (active in XM Live, My XM and Record modes). When a person presses the Memory button, the device 100 stores the information for the channel currently playing. The device 100 displays "Saved" for 1½ seconds, then returns to normal screen display. Later, a person can recall song information stored in memory by pressing and holding the Memory button for 2 seconds. The device 100 displays "Memory 1" on the first line, the Channel Name and Number on the second line, Artist Name on the third line and Song Title on the fourth line. A person can advance through the memorized songs manually by pressing the Memory key again or using the XM Jog Dial to move to next and previous songs in Memory, after the device 100 is in the recall mode. A person can also push and hold the XM Jog Dial (up or down) to move quickly through the list. There are a fixed number of song titles (for instance, 15) that can be recalled. The device 100 preferably purges information by first-in first-out. The device 100 will time out of Memory 8 seconds after the last button/knob is pressed or turned. A person can also escape Memory and return to normal display of the current song by pressing Menu.

The PAD is used to assist navigation through the content stored in memory. For example, the NEXT button allows the user to move the playback location from the present song to the start of the next song. The BACK button allows the user to move the playback location start of the present song or to the previous song if pressed at the start of the present song. The memory locations of the start of each song may be indexed based on the time synchronized change of the PAD updates (new song title) in the Broadcast Information Channel (BIC) or in the auxiliary data field, as described above. When the PAD information is updated, the new PAD information is immediately saved, along with the memory location in which the streamed content is being stored at that instant. This allows the user to merely press a button to flag specific songs for purchase while listening to content during regular broadcast or to a preview broadcast. The PAD is used to identify the content for purchase either from the content provider or from a third party vendor. Description of "memory button" and "buy button" are merely exemplary. The User interface may differ. Functions may be called by same button or different buttons or combination of buttons or controls.

In another embodiment, the device 100 is also provided with nonvolatile memory for authorized storage of songs (e.g., purchase and limited copying capability). The device 100 can be used to temporarily store a preview stream. Once song selections and purchases are made via the user application program, the songs can be saved for unlimited playback on a player. Superior storage capability is available using external memory devices. In addition, multiple channels can be stored simultaneously using, for example, HCMOS9 technology.

Once the PAD data is flagged, the PAD or the content itself or both are transferred from volatile memory to non-volatile memory that will not be overwritten or erased when the device is switched off. This insures that a copy of the content the user flagged may be purchased at a later time.

In another embodiment, the device 100 is provided with an auto record function. Customers need a solution where they can listen to XM in situations (e.g. jogging) or locations (airplane rides, some indoor locations, etc.) where XM reception is not possible.

Consumers can record content for future use, but requiring someone to specifically set-up and dock a receiver every night to store fresh programming is very inconvenient and will not be done by most consumers. Thus, their receivers will not have fresh content available when they are unable to receive an XM signal, severely limiting the usefulness of this record function. A user may want fresh content, but not want to spend the time to affirmatively schedule times. A user can set the device 100 to automatically record one or more favorite channels whenever the device 100 is placed in a certain condition, such as, for example, being connected to the home or car dock or in a recharging dock. Or, in an embodiment, the device 100 refreshes a designated portion of non-volatile memory whenever a good signal is available. The process of storing is described in greater detail below. If a person chooses Auto Record, he sees a screen with a complete list of all XM channels by Channel Number and Name with a space before each. He uses the XM Jog Dial to scroll through the list and check off the channel that he wants to be recorded (by pressing in). In choosing a channel, the unit beeps for ¼ second and the screen displays "Auto Record Set" at the top, the channel number and name below it (highlighted), and two additional options below—"Change Channel" and Auto Record Off". If a person chooses "Change Channel" he sees a complete list of channels as noted above and can choose a new channel. If he chooses "Auto Record Off" the screen displays "Auto Record Off" and beeps, and then returns the person to the main menu.

Additionally, it should be understood that any number of factors can be used to determine the content to be stored in preview memory. These factors may include user surveys, user purchasing patterns, or other user demographics.

In accordance with another aspect of the present invention, a wearable, portable device 100 is provided for receiving, storing and playing back a satellite broadcast signal. As described in more detail below, the wearable device 100 enables a user to record at least one channel from the satellite broadcast stream for a selected period of time. Of course, embodiments are not limited to recording one channel, and may record multiple channels simultaneously, depending on hardware limitations. The recorded and stored content is automatically erased or overwritten after expiration of a selected period of time or a selected number of plays or some other criterion, and is not downloadable, tradable or otherwise transferable.

A user may want to store a certain broadcast to playback later, such as a concert or interview.

Thus, the wearable device 100 is able to operate in one of two modes. In the first mode, a user is able to listen to a selected channel from the live broadcast with good signal reception. An indication is provided on the player indicating when signal reception is good.

To overcome situations when reception is bad, or when the user is unable to listen to desired broadcast content in real-time, the user can elect to record the selected channel(s) for a selected period time. The user can select not only which channel(s) to record but also the times to record the channel (s). The device 100 is provided with a memory device such as a random access memory and time management programming control to determine when to record a channel and for how long, as well as to determine when the content should be erased from the memory device or overwritten.

The device 100 is not limited to auto recording only when in a cradle but also while the user is listening to the device 100 and the signal reception is good. This insures that the user is not listening to stale content.

Of course, the receiver can have the ability to tune to more than one channel at once, allowing the receiver to play one channel live while automatically recording one (or more) different channel(s) in the background, and include a memory buffer to allow the receiver to measure the quality of the current reception environment before automatically starting to record.

Additional features also include the capability to provide recorded content to a listener or viewer when the live broadcast is unavailable or lacks sufficient quality due to any number of reasons.

Furthermore, the device 100 may automatically record while recharging thereby relieving the user from having to remember to initiate the recording session.

Thus, their device 100 will have fresh content available when they are unable to receive a live broadcast signal.

The device 100 receiver can be set-up by specifying a favorite channel (or more than one) that a consumer wants recorded automatically. Whenever the receiver is active and tuned to any live broadcast channel, it automatically begins filling a partition in the non-volatile memory with the signal from the designated favorite channel.

The user can also select a favorite category or categories (such as an artist or genre) that the user enjoys and content from any of the channels or combination of channels in that category may be recorded.

When the user stores content, it should be equal in quality to the live broadcast content. To insure quality, the received signal is analyzed. An exemplary process of checking stored content for a minimal quality metric will now be described. The signal quality mentioned above is important because the recorded content must be of the same quality as expected by the user when they are listening to the live broadcast. The quality of the signal is measured by the number of mutes, the number of no signal indications, the length of time for a mute or no signal indication, or a combination of these.

In another embodiment, automatic recording would begin storing content to a memory buffer either when the unit is recharging or at any other time when the device is active in either Live mode or My XM mode and good signal reception is indicated. Once the memory buffer has a designated amount of information stored, the receiver checks the quality of this recording.

If it is a high enough quality, it is assumed that the current listening environment is a good one and that the receiver is going to be on for more than a few minutes. This buffer is then automatically saved to a multiple hour (preferably 4 or more) memory location in the device. The real-time recording continues to get stored in this buffer and checked for quality, then moved to the larger non-volatile memory in short blocks (preferably 2 minutes each), assuming they each pass a signal quality check. If the recording in the buffer fails the quality benchmark, the buffer is erased and begins refilling before being checked again. This process continues until the temporary buffer is full and passes a quality test, at which point it is transferred to the larger, multiple hour receiver non-volatile memory partition and starts filling in smaller blocks and dumping to the larger memory until one of these smaller blocks in the buffer fails the quality test again. The receiver inserts a pause, tone, or other identifying separator between separately recorded noncontiguous information. The multiple hour memory in the receiver is preferably set-up on a first-in-first-out basis. Thus, the oldest content is automatically overwritten by new content as described above. Thus, a consumer has fresh content stored on their device 100. A record button is included that would automatically cause the receiver to begin recording the channel it is currently tuned to for regular listening (versus the specially designated record channel). This will allow a consumer who hears something they want to record instantly while listening live the ability to do so.

Users also preferably have the ability to record a designated channel on demand, as in the channel they are listening to, or to schedule recordings by channel, time or duration.

Another unique feature of the portable device 100 allows the record button to be pressed at any time so consumers can have access to this feature in their cars, at work, etc. The content will then be always available for the user to replay. If there is no signal present when it is pressed, the unit will beep, an error message will be displayed, and it will not start recording. If there is an extended mute (15 seconds or longer) during recording, the unit will stop recording for the remaining duration of the mute and display an error message at that point during playback. For example, if a terrestrial repeater goes down, a tree branch moves in front of the signal, or some other event blocks the path, the unit will not record blank content over the entire memory. In one embodiment, putting the device in the charging dock starts the process of filling the "auto-record" function.

A menu setting (default=off) allows the unit to be set up to automatically record on a predetermined channel when the device 100 is placed in the home dock. Personal computer software included with the portable device 100 provides the ability to schedule recordings and control the channel and track. This way, a consumer can program a specific time and channel number to record at a later date (as long as it is connected to a computer).

In another embodiment, the user is able to select multiple channels (e.g., eight channels) for concurrent recording and the desired times for recording. A total of ten hours of recorded content is stored, or more, depending on memory device constraints. Similarly, the recorded content can be automatically erased or overwritten after a predetermined amount of time or a predetermined number of plays, or based on any some other criterion.

Now various memory management functions performed by embodiments of the invention will be described in further detail.

The devices 100 will also be able to perform functions such as scheduling a time and length for recording content for later playback (Time-shift function) and buffering live content for real-time replay (Replay function) while the live content continues to be buffered. The microprocessor 112 of FIG. 13 coordinates storing content for subsequent playback at another time and manages the memory for the Replay function. The time-shifted content is stored in a memory location that is under control of the microprocessor 112.

The microprocessor controls whether the user will have complete access to the time-shifted content or limited access. Allowing complete access to the memory allows the user to transfer the stored time-shifted content from the XM device memory to other devices. Conversely, limited access only allows the user to navigate (forward, rewind, fast forward, skip, etc.) through the time-shifted content. Preferably, the user may be able to flag content for purchase as in the preview function above.

The Replay function is more complex and requires continuous buffering as the memory locations allocated to the Replay function are filled and overwritten. Replay is best envisioned as a circular loop of memory that is filled, emptied and refilled as the programmed content progresses.

Exemplary management of the data structures will now be discussed. Of course, these are exemplary for purposes of description and to gain an understanding of the invention, but not be considered limiting.

Figure 14:
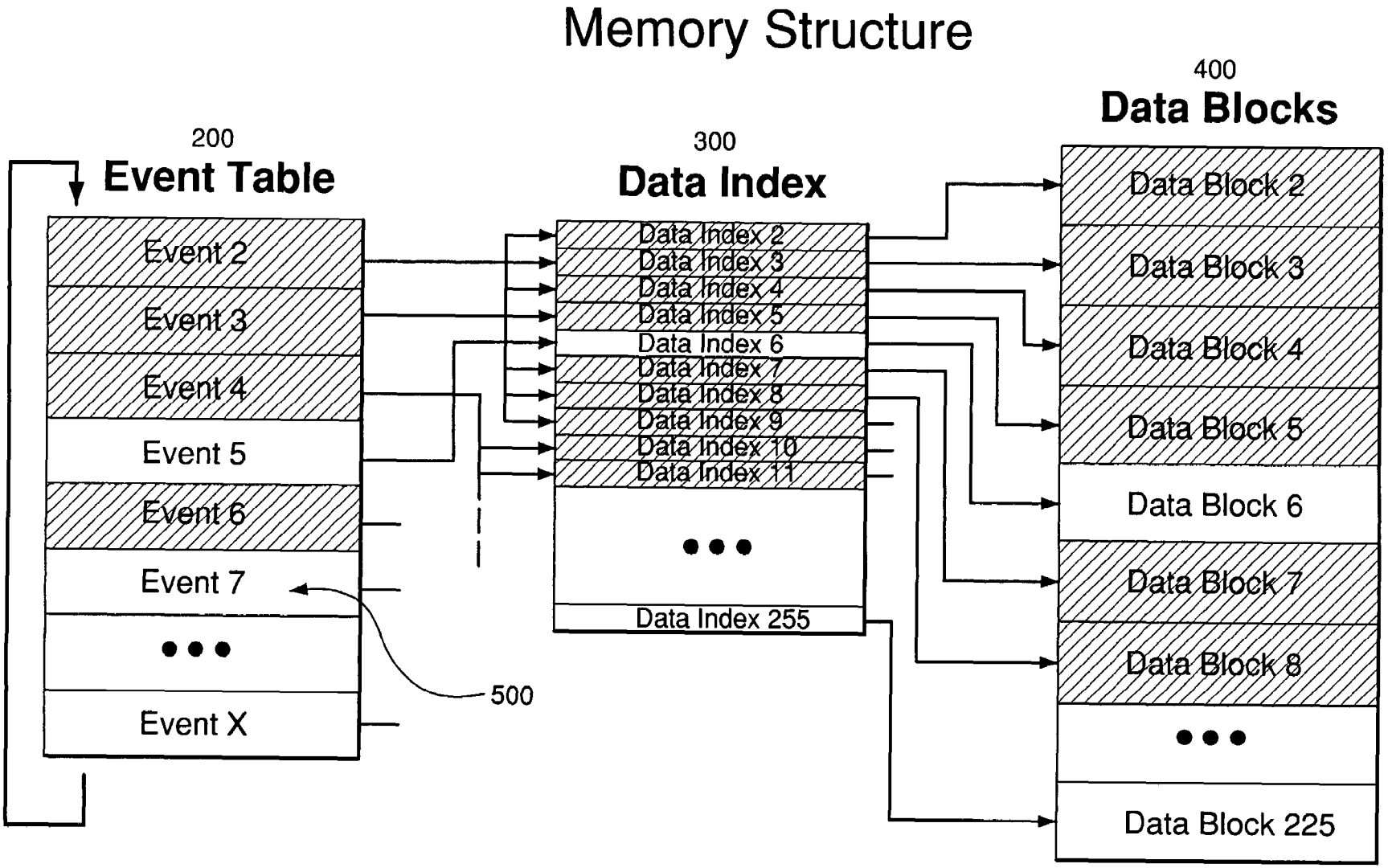
FIG. 14 is a block diagram of a memory structure for a Replay function in accordance with an embodiment of the present invention.

As shown in FIG. 14, the temporary or volatile memory may be organized into three structures: Event Table 200, Data Index 300 and Data Blocks 400. The Event Table 200 is a block in memory containing a list of Event Fields. An event corresponds to a related group of segments on a particular channel, such as a song, for instance. The Event Fields are used to store the Event number, the event transport parameters received from the Data Port and the label parameters. During playback of a given Event, the memory manager references the Data Index 300 to correctly extract data from the Data Blocks 400. When a new Event is reached in the Data Index 300, the memory manager accesses the Event Fields to extract the data necessary to enable the system controller to reconfigure the audio decoder and/or update the display contents before continuing playback. Data Blocks 400 are a fixed size memory element for storing end user data. The Data Block 400 size for the replay application is preferably 64K Bytes. The Data Index 300 is a table which associates Events with Data Blocks 400 stored in memory. This table is used by the memory manager for Data Block Management, including Data Block assignment to Events, Data Block deletion from Events and audio playback pointer management. The device prepares for recording as soon as it is turned on. The Event Table 200 and Data Index 300 are initialized each time power is applied. For the Event Table 200, a first memory location of the GLOBAL STATUS is set and the first memory location of each start location is set, which indicates the Start Locations are available. For the Data Index 300 a first memory location of each Block Status location is set, which indicates all Data Blocks are available. At the completion of recording a data frame, the GLOBAL STATUS of the Event Table 200 is checked and if the check fails, the memory is reinitialized and recording restarts.

Recording starts in the first available Data Block 400 which is identified by locating a specific Data Type in the Data Index 300. A Data Block 400 being a memory of fixed size for storing end user data. The Data Index 300 is a table that associates Events with Data Blocks. An Event 500 is a segment of data storage with fixed transport parameters (preferably, source identification (SID), Service component type, service component rate) and fixed label parameters (preferably, Artist, Song).

Once a Data Block 400 has been identified, an Event number is assigned and entered into the Data Index 300 Event number field along with preferably Event Type, the SID, Block Sequence number, Open status and the number of Frames. Next, the Event details are recorded in the Event Table at the first available Start Location. Data is then loaded in frames of compressed audio data. On completion of each frame, the Block Status field in the Data Index is updated with the correct number of Frames stored in the Data Block 400. Once the number of Frames reaches a predetermined number, the Open status is changed to Closed and the next Data Block is selected. When selected, the Data Index 300 Block Status fields are loaded identical to the previous Data Block except the Block Sequence number is incremented, the status is Open, and the number of Frames is set to zero. The Data Block 400 is loaded in frames as before until the Frame Count reaches its predetermined number. If a change of Event occurs at any period the Data Block is open, loading of the present frame of data is completed, the Frame Count is incremented, the status is set to Closed and the Block Sequence number is set to a predetermined value. The next Data Block 400 is selected, the Event number is incremented and the associated Block Status field is loaded with preferably the new Event number, the applicable Event Type, SID, Block Sequence, etc. As before, Event details are then recorded in the Event Table at the next available Start Location, followed by the next frame of compressed audio being stored in the new Data Block.

The next Data Block 400 for storage is preferably the next highest qualifying Data Block number. The memory manager identifies the Next Data Block by sequencing through the Data Index 300. A Data Block 400 qualifies if it is either of the same Data Type or has a specific Data Type Status. A Data Block 400 does not qualify and is skipped over if has a different Data Type or it is Locked.

The next Start Location for loading new Event Details is preferably the next highest qualifying Start Location number. The memory manager identifies the Next Start Location by sequencing through the Event Table 200. A Start Location qualifies if it is either of the same Data Type or has a specific Data Type Status. A Start Location does not qualify and is skipped over if has a different Data Type or it is Locked.

Audio playback may start from a previous event, where the user may select the location by sequencing the label stored in the Event Fields, or from a previous time, where the user selects the location based on an number of frame periods shown as time on the display. The start pointer for playback is reversed in time (or labels) by sequencing in reverse through the frames in the Data Blocks (or a specific Sequence number, Event Type Data Blocks).

The user may desire to preserve some of the content and locking an event may simultaneously lock all data Blocks associated with that Event. Upon locking each Data Block, the memory manager may the reassign Event number Field to a Locked number Field and assign a new Locked number which can be separately selected by the user. During normal Playback Locked Data Blocks are skipped.

Volatile memory is used in the Replay mode to buffer a predetermined amount of content for the user. The amount of content may be based upon time or bytes of memory, as examples. The volatile memory allows the user to stop his Live XM listening and replay the content the user had just heard. Additionally, volatile memory may serve the purpose of buffering content for quality analysis as described with respect to the autorecord function. The configuration of the volatile memory may be separate memories to perform the temporary buffering for quality analysis and Replay mode or a single memory partitioned into separate tracks to perform the functions of quality analysis and buffering for the Replay mode.

A device 100 is provided which has no nonvolatile memory but rather only volatile memory for temporarily storing a stream of content comprising a plurality of songs and related information such as artist and title. The portable device 100 can be connected to a computer with the user application program to facilitate navigation, selection, purchase and downloading of songs previewed in the stream of content.

Nonvolatile memory will now be described in greater detail. In an exemplary embodiment of the present invention the non-volatile memory may be partitioned into a plurality of tracks by user depending on which functions the user wants to implement and is only limited by hardware constraints. For instance, the user who likes hard rock may share his car device with his wife, who likes country music. Both also like to listen to an early morning talk radio show and to buy songs and store them on the car device. To accomplish all of these tasks the user would like to partition the memory into several partitions: one for the husband to record some hard rock content while his wife is using the car, a second for the wife to store her songs selected for purchase, a third for the husband to store his songs selected for purchase, and a fourth for them to store recorded content from their favorite early morning talk radio show. Therefore, to satisfy the diverse recording needs of the hypothetical couple, the memory may be partitioned into four equal tracks of memory. For example, if the memory were 512 Mb, the four tracks would each be allocated 128 Mb of memory to store content.

The user may also decide that content within the individual tracks should not be overwritten, such as a broadcast of a historic event (e.g., Phil Mickelson winning the Masters or Barry Bonds hitting homerun number 660). To prevent overwriting content, the user can lock content within the track. The memory manager will skip over the locked content and overwrite content in the unlocked memory locations. Partitioning allows the users to perform a variety of functions while insuring that the device can function.

Memory partitioning may be accomplished either by channel or by recording time block. For example, a consumer can, via the menu, configure this feature for 1 (default), or 2 "tracks." The memory will automatically be divided among each of the available tracks and is not otherwise user-configurable. (For example, if the 2 track option is selected, each track will preferably have half the memory that a single track would have had.) If a person has activated multiple tracks in the menu, when he presses the "record" button he will first see a display screen with each track listed and courtesy reminder of the date and time the last recording session was started on both tracks, along with the channel number recorded (or the word "empty" if a track has no data). The user will then select a track and the unit will begin recording on that track, following the same rules as for a single track above. In an embodiment, the user can record two or more channels in succession; however this requires a channel change. Alternatively, the recording may only be of the present channel (recording always contains same content present on audio jack) being listened to by the user. Although the user may change channels while recording and the recording will continue on the new channel. In another embodiment, the user cannot delete tracks, or specific information on each track, but can only record over existing content or clears the entire memory by changing the number of tracks. Finally, all recorded content is preferably deleted (after warning) when switching between 1 and multiple track modes. The total number of hours of recording (e.g., six hours) can be any predetermined amount of time depending on the constraints of the memory used in the wearable device. Also, although the above description was given with reference to only 2 tracks, the number of tracks can be any predetermined amount of tracks depending on the constraints of the memory.

The device 100 is preferably provided in "basic" and "advanced" versions. A basic player will now be described. In the basic version, a user can elect to record one XM channel at a time for a total of preferably six hours. The content is preferably erased after three days or on a first in and first out basis. For example, a combination of flagging operations and timing operations by the programmable processor can be used to determine which content in the memory device is to be erased after three days. The device 100 allows for new content to always be temporarily recorded and therefore available for time-shifted play back.

In the advanced version, the user is allowed to select multiple channels (e.g., eight XM channels) for concurrent recording and the desired times for recording. A total of preferably ten hours of recorded content is stored, or more, depending on memory device constraints. Similarly, the recorded content can be automatically erased or overwritten after a predetermined amount of time or a predetermined number of plays, or based on some other criterion.

If a person has activated multiple tracks in the Menu, the device 100 can record on the multiple tracks. When this is the case, the user will see a display screen before the unit starts to record. It will show the number of tracks and "Empty" next to tracks with no recorded content, and the date and time of recording for tracks with content. The screen will display a message, such as: "Choose Track to Record".

A person may use the XM Jog Dial to move the highlight (the highlight will default to the first empty track) and press in to begin recording on that track. If there is content on the track, it will begin to record at the end of the last recorded content. It will loop around and, if necessary, record over previously stored content. It will stop recording when it reaches the beginning of the current recording session.

The memory can be partitioned in the Advanced Options Menu through the Set Tracks option. A person sees a screen with "Change Number of Tracks" and three tracks listed below. Active tracks show the number of minutes of recording for those tracks (the default setting will be one track with all recording time next to it; tracks 2 and 3 are empty). If a person chooses to change the number of tracks by highlighting and selecting it (using the XM Jog Dial), the screen will display "Are you sure? All recorded content will be erased" "Yes" "No." If a person chooses yes, he will see a screen with the new number of available tracks and the new recording time next to each track(s). A person cannot control the amount of memory assigned to each track; it is done automatically—if two tracks, available memory is divided in half; if 3 tracks, memory is divided into thirds. If a person chooses "No" the screen will display "Cancelled" and return the person to the previous screen with number of tracks set.

As stated above in regard to recording content, that particular tracks of memory will be overwritten on a First In, First Out basis. However, there are envisioned instances where the user would like to retain content for the maximum allowable time. The user, for instance, may not have had time to listen to a complete interview, or wants more time to decide whether to purchase preview content. To do this the user may lock a portion of the content, which prevents the device 100 from recording over the locked memory. However, in the preferred embodiment, the locked partition is also unavailable for auto-recording or for storing content that the user designates for an instant or scheduled recording. Thus, the user has a block of memory that can advantageously be configured according to their preference, with a trade-off between how much content they can store semi-permanently, and how much memory they have available for storing additional broadcast content.

Thus, for example, in one embodiment of the invention, the non-volatile limited control memory comprises an eight hour memory. That is, the memory is of sufficient size to store approximately eight hours of broadcast content. This memory can be configured by the user, through the user interface of the device, or through a PC interface, into multiple partitions. It will be understood that the partitions can be divided into any number and combination of sizes. However, in the preferred embodiment, the user will select a number of partitions, and the device 100 will create that number of equal sized partitions. The user is then able to use the designated partitions to their preference.

As an example, an eight hour memory can be divided into two tracks. One track can store a scheduled recording. That track can then be locked by the user. Thus, it will not be erased or overwritten until it is unlocked. However, once it is locked, no additional content can be added to it. A second track can be designated for auto-recording. Thus, the second track is periodically and automatically updated with fresh content from a favorite channel, or from favorite artists on any channel. This content is preferably stored on a first-in-first-out (FIFO) basis. In other words, the oldest content is the first to be overwritten. However, other algorithms may be used to determine which content is overwritten first.

It should be understood that in an SDARS broadcast signal, the number of channels can be on the order of several hundred. Most examples given herein illustrate a single channel being decoded and stored at one time. However, depending on hardware limitations, any number of channels in the TDM signal can be decoded at a given time. Thus, it should be understood that devices according to an embodiment of the present invention can include the ability to store broadcast content from two or more channels simultaneously.

The advanced version of the wearable player 100, in contrast, has a PC interface for more advanced features with regard to scheduling the recording of content from the broadcast stream, among other options. The advanced version of the wearable player 100 is also SDMI-compliant and can include a memory encrypted with Microsoft Corporation's Hardware Identification (HWID) security measure.

Because the broadcast content is preferably from an XM Satellite Radio broadcast, the files are stored in a proprietary codec. Thus, only limited security measures are required to protect the unauthorized copying and use of the content. This is because content is difficult or impossible to decode and utilize outside of an authorized XM device 100. However, it should be understood that encryption methods can also be employed to protect stored content, particularly in an embodiment in which data can be transferred out of the device 100 to an external device Once the user acquires by purchase or authorized use content it must be stored somewhere for permanent reuse. The content purchase transaction may take place either on a personal computer or over a cellular device, or by some other network communication. The user owned content may be stored on the personal computer, recorded onto a CD or DVD, or downloaded to the player permanent personal memory.

In one embodiment, content that is purchased and then stored onto the player is not transferable out of the device 100. This prevents free file swapping.

In another embodiment, content is encrypted for use on only user owned or operated devices. This would allow transfer of the content among the users' devices 100 but not to unauthorized users.

A device 100 according to an embodiment of the present invention provides several advantages over MP3 players. MP3 players generally require a user to spend a significant amount of time at a computer selecting content and overseeing the downloading of it, which can sometimes be corrupted. Whereas a user downloading content from the web for MP3 players must use several key strokes and spend a significant amount of time at a computer, the XM receiver player allows a user to store the content in memory merely by depressing a single button. Additionally, the specific channels and time for recording may be selected by the user. The selected content from the broadcast stream or temporarily stored, time-shifted content that is recorded using any of the XM devices of the present invention is of superior quality and provides superior content availability. The broadcast stream advantageously includes titles that are not individually selected by the user, but rather are programmed by the broadcaster. The user is instead experiencing the high quality play list available from the broadcast content stream, and is therefore exposed to new music and other programming for a more spontaneous listening experience. New content is always available from the broadcast stream programming source, and content is frequently refreshed at a convenient time such as overnight while the device 100 is recharging, or when the user is using the device in an area with good live signal coverage. The storage of the broadcast signal using the device avoids poor recording, file errors and time wasted monitoring music downloads often associated with MP3 players and similar devices. In one embodiment, the device 100 does not need to operate in conjunction with a personal computer or an Internet connection, nor is there a need to burn CDs. Additionally, a user must often times spend a significant amount of time searching for desired content at possibly several on-line vendors before finding the content they desire.

Figure 15:
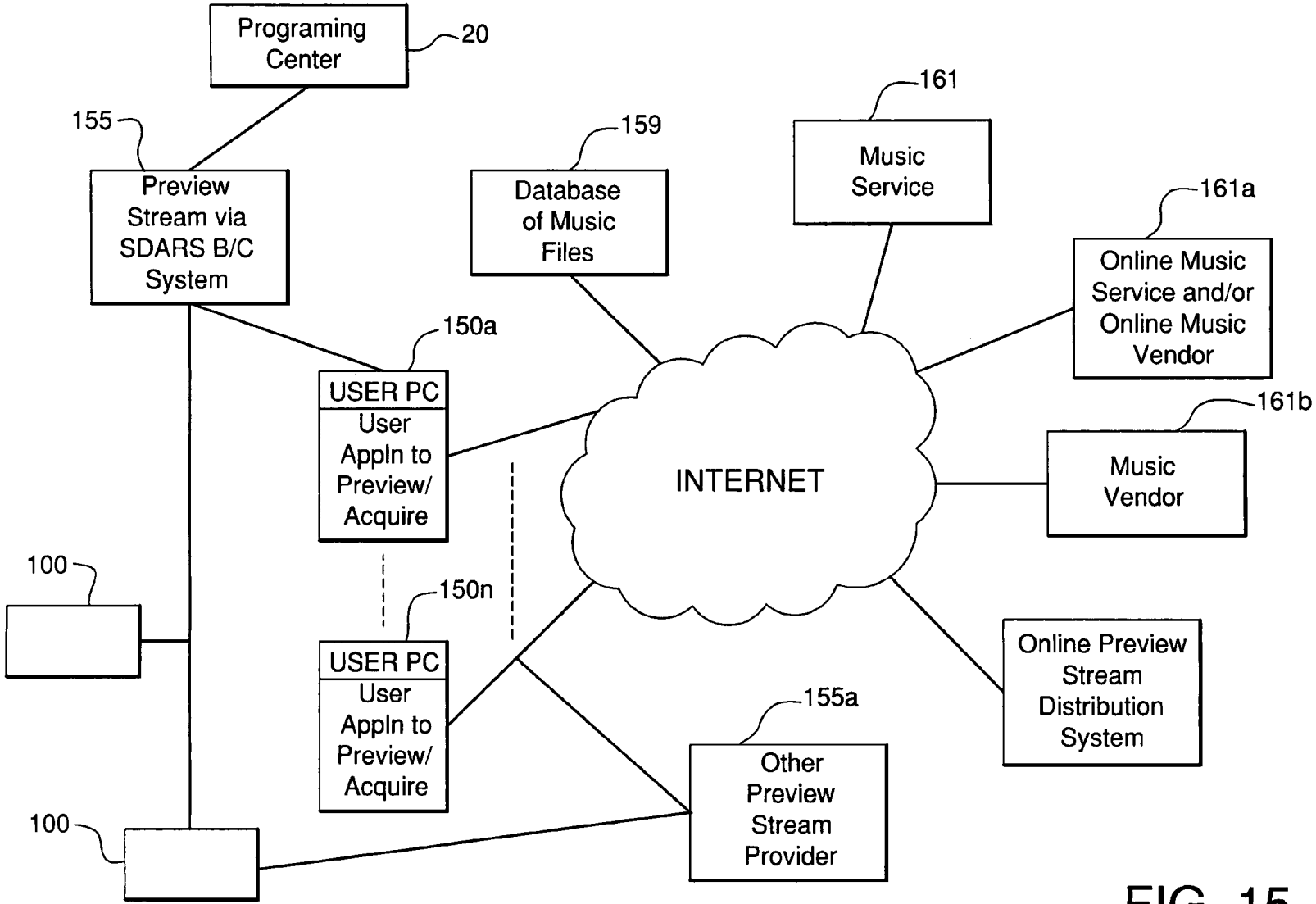
FIG. 15 is an overview of a user purchase method in accordance with an embodiment of the present invention.

A system for previewing and purchasing content according to an embodiment of the invention will now be described. With reference to FIG. 15, a system in accordance with the present invention is depicted comprising a plurality of user PCs 150*a* . . . *n* or other devices 100 with which to receive, store and playback preview content, as well as to acquire and store digital music files for unlimited playback. The preview content provider 155 can be SDARS-based, as described in more detail below, or other broadcast system (e.g., via the Internet, or a wireless network different 155*a* from the satellite broadcast system for SDARS). The users can acquire music files from a database 159 (e.g., as described below in connection with the XM Satellite Radio Inc. service), a music service 161, an on-line music service and vendor 161*a* or a music vendor 161*b*.

The programming center 20 broadcasts the content stream with its rich variety of content. The user devices 155*a* . . . *n* and 100 receive the content of the broadcast, which may have a combination of older content and have additional new content. The user device 155*a* . . . *n* and 100 allows the user to "browse" through the content at their leisure for a period of time. Preferably, the user will select some of the content for purchase. The ability to purchase content is based on the ability of the user to easily select the content they would like to purchase. The user identifies the content either through the press of a button or some other operation that allows the device to know which content the user wants to purchase. The device 100 will then transfer the content and or content related data into a particular memory (e.g., nonvolatile memory or personal memory) location for further use in purchasing the content.

The stream of content comprises a plurality of songs, or at least portions of songs, that are preselected, that is, the songs are selected by a content provider for electronic distribution or broadcast in the stream content. The stream of content is available to users for preview purposes. In other words, users get to listen to contemporaneous content that has been selected and broadcast to them by a broadcaster. The stream of content is preferably stored on a temporary basis at a user processing and storage device. A user desiring to permanently store one of the songs from the content must purchase or otherwise perform an authorized download from a vendor for that song.

As described above, the broadcast radio stream of content preferably comprises ancillary data or PAD in addition to the songs therein. The ancillary data can comprise artist, song title, music genre or category (e.g., rock, classical, rhythm and blues, country, and so on), channel identification, song duration, as well as a unique identifier in the database of the content provider or broadcast entity that generates the broadcast stream of content or the owner of the content. The broadcast stream is operable in conjunction with a user application, which can be downloaded to the user's computer, to allow navigation among the song titles and other information such as artist or music genre of the temporarily recorded content stream to facilitate the selection of songs for playback (i.e., on a temporary basis) and acquisition for authorized permanent storage and unlimited playback.

Ancillary data preferably includes vendor specific information. The Preview feature takes the SDARS broadcast stream and buffers a portion (e.g., PAD) or all of the content into a memory. The user can then scan through the content stored in memory and chose content to purchase. In one embodiment, the user simply presses a button, which "flags" that content for purchase. The "flag" can cause PAD or the entire song to be stored, preferably a purchase transaction must occur for the user to have unlimited access to the purchased content. The purchase transaction can occur in two ways. First, if the content is owned or licensed to XM, a purchase signal can be sent from the user's device 100 and the content can be downloaded to the device 100 and stored in a nonvolatile memory, such as the personal memory described above. Second, the user can connect the device to a PC and conduct the transaction over the Internet.

The personal memory stores PAD such as song title, artist, channel, and so on when, for example, a user depresses the memory button on the device 100. The preview memory module also stores PAD or similar data transmitted with the broadcast stream as described above. The PAD or similar data in the preview memory module is useful for navigation as described in more detail below in connection with the description of the user interface buttons (e.g., NEXT, FAST FORWARD and FAST REWIND). The preview memory saves changes in the PAD or similar data that is associated with each different song or other music file that is received and temporarily stored along with indices to the corresponding memory locations of the temporarily stored files. The indices, in turn, facilitate jumping to another song or music file in the preview memory module.

The database of music at XM Satellite Radio Inc. generally includes unique identifiers for each song title, among other information. In accordance with another aspect of the present invention, third-party vendor information is transmitted in the broadcast stream, and can also be stored for each song title. The user application, in turn, facilitates a transaction with the database whereby a user request to acquire one of the songs in the stored preview stream is processed to route or map the request to the appropriate purchase option (such as a music download service, from a recording company, ASCAP, or other group). The user download request interface is particularly valuable in view of the XM Satellite Radio's wide variety of broadcast content. As an example, the XM Satellite Radio broadcast stream can include songs by unsigned artists in addition to songs by bands signed to major record labels. A user can therefore easily acquire songs from an unsigned band as easily as they would from a major record label band. Thus, the artists benefit from the increased exposure and sales channel, and the download users benefit from an increased selection of music that would not otherwise be available for downloading.

Additionally, the content temporarily stored in the memory device allows for creation of a personal music library and play list(s) which can be downloaded or synchronized to a database on a personal computer. The connection to the personal computer can be via a wired interface such as USB or a wireless interface such as Bluetooth or 802.11. The user can add a song to their personal music library play list by simply pressing a designated "buy" or "save" button while listening to the desired content and the associated PAD data is then saved to non-volatile memory (or alternatively the content from the broadcast stream itself is transferred to personal memory). This is useful when a particular artist interests a user, for example, as the preview stream provides a comprehensive list of the users selected music channels and the content therein. Further, in the preferred embodiment encryption is optional since the digital content is isolated within the XM device.

The content temporarily stored in the memory device allows for creation of a personal music library and play list(s) which can be downloaded or synchronized to a database on a personal computer. The advanced version of the wearable device 100 has memory expansion slots to accommodate other memory devices and increase the amount of total time for selected and temporary content storage. For example, the user can elect to store content from eight XM channels for a period of time as much as 30 hours. As stated above, the recorded content is automatically erased after a selected period of time or some other condition.

Figure 16:
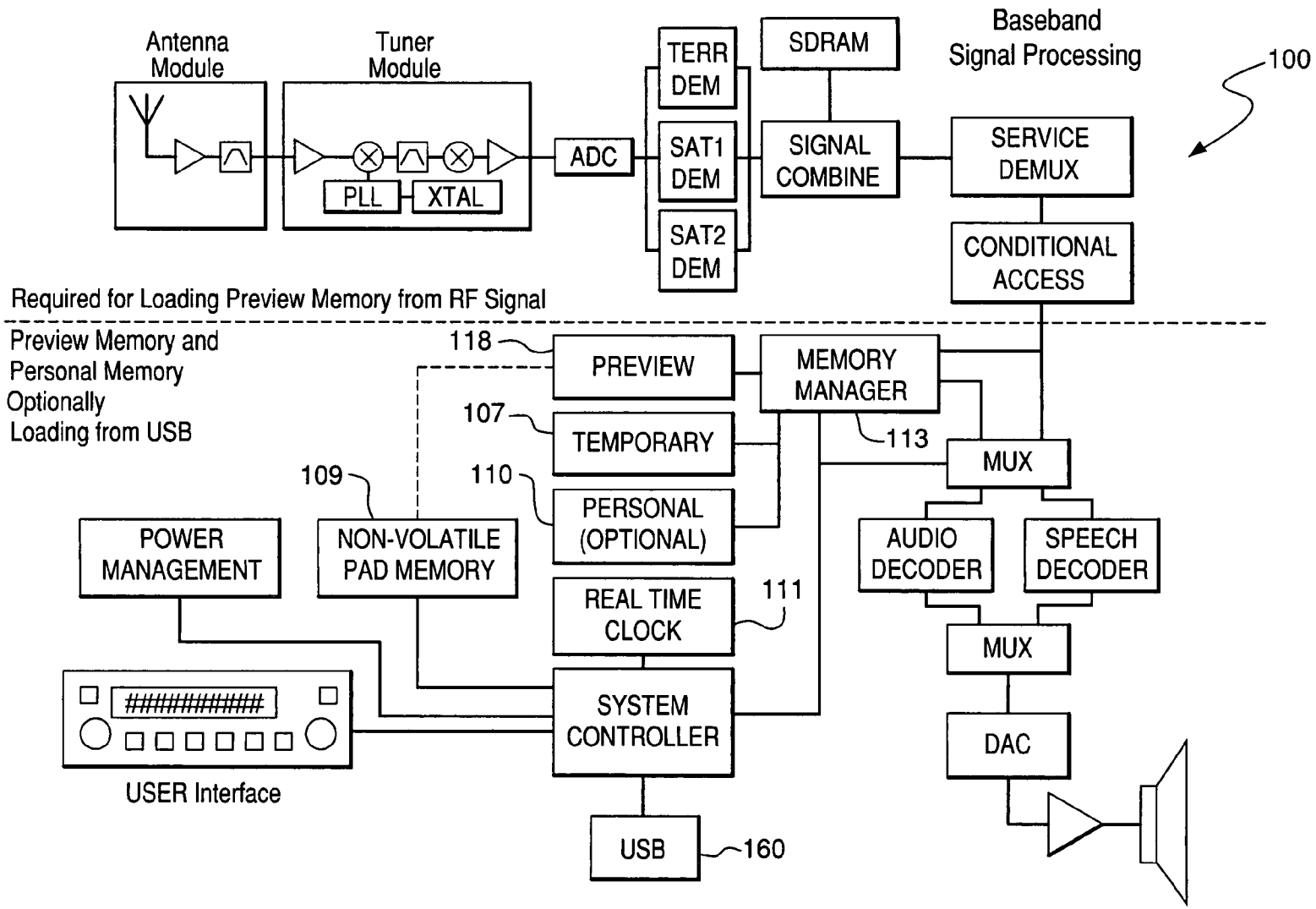
FIG. 16 is a schematic diagram of a device constructed in accordance with an embodiment of the present invention.

With reference to FIG. 16, the receiver 102 is provided with a memory manager module 1602 to automatically store content from a received content stream to a non-volatile limited control memory, herein referred to as a "preview memory" 118. The preview content is playable from the preview memory module. The memory manager 113 module tracks when files are stored in the preview memory 118 for preview purposes and manages file deletion or overwrite. Additionally, PAD information of content "flagged" for acquisition is stored in a PAD memory 109 that may be a partition of the preview memory 118 or a stand alone memory, as shown in the figure. The memory manager 113 module is provided with real time clock data by the real time clock 111, so that preview memory files may be either deleted and or overwritten. This insures that content that was "flagged" for acquisition, but was not acquired within the time period or within the number of plays is removed from the device. However, the PAD information will remain for future acquisition, if desired. An optional personal memory 110 can be provided (e.g., in a receiver, wearable device, or in a card slot(s) of a PC) for storing content (e.g., digital music files) that has be purchased or otherwise acquired in an authorized manner for unlimited playback. The acquired content can be provided to the personal memory 110 via a universal serial bus (USB) 160 or other interface between a computer and a peripheral such as the receiver 102 if the receiver is separate from a computer (e.g., a wearable player, car receiver, home stereo unit receiver, and so on). If the previewed content is purchased and available from XM, the content is moved to the personal memory 110 in its entirety. If the content is not available directly from XM, the content PAD or other identifying data is moved to personal memory 110 for future purchase.

The Buy button feature of the wearable player makes this transaction seamless because the push of the button forwards all previously-entered required buyer data to XM Satellite Radio Inc. or affiliated vendor, who then provides the purchased content via download. The purchased content then is stored in memory for permanent use by the purchaser.

The preview stream is referred to herein as a broadcast stream since the same content stream can be generated and transmitted to a plurality of users. As stated above, the preview stream comprises a plurality of songs or other digital media content that are preselected. The preview stream can be provided to users of digital media downloading services by any of a number of different methods such as via the internet or wireless transmission.

PAD memory may be any nonvolatile memory that the device uses to store data related to content "flagged" for acquisition. The memory manager makes the determination where PAD data should be stored.

As an example, personal computer interface software has the ability to make some setting changes on the device. Specifically, the PC may control the channel selection, the track selection and the record on/off position, generally, all functions may be controllable by the interface software. This way, it will include functionality that lets consumers program a specific time and channel number to record a selected channel at a later date (provided that the device receiver is docked to a home dock and connected to the computer at that time).

As an example of how buy-button shopping, scheduling of recording, and personal computer functionality may be implemented, a common bus messaging command may be implemented by the application controller that allows an external processor to access the processor directly. This command would automatically be sent to the device 100 when docked in a home base with USB that is connected to a computer and the personal computer software application is opened. Once this happens both the player controls and the PC will be able to independently control the player. Unique settings on each platform, such as presets, TuneSelect/Favorites, memory/buy buttons, etc. will not be duplicated by will remain specific to each user interface. However, once a consumer selects a new channel from either the player or the computer, the other user interface will display the information for the new channel either on the basic display for the player or in the now playing section of PC display.

The user can add a song to their personal music library play list by simply pressing a designated "buy" or "save" button while listening to the desired content and the associated PAD data is then saved to non-volatile memory. The device is synchronized to the user's personal computer (PC) to, for example, list categories of music and artist names within each category that have been selected for authorized acquisition by the user on the personal computer, as well as to update the play lists as new selected content from the broadcast stream is recorded. This is useful when a user is interested, for example, in purchasing music by a particular artist as it provides a comprehensive list of the user's selected music channels and the content therein.

The device 100 is provided with a memory manager module to automatically store content from a received content stream to a personal memory or other nonvolatile memory. The preview content is playable from the memory. The memory module tracks when files are stored in the memory for preview purposes and manages file deletion or overwrite (e.g., after a selected number of playbacks or after a selected amount of time), as described herein. An optional personal memory, such as a Flash memory, can be provided (e.g., in a receiver, wearable device, or in a card slot(s) of a PC) for storing content (e.g., digital music files) that has be purchased or otherwise acquired in an authorized manner for unlimited playback. The acquired content can be provided to the personal memory via a universal serial bus (USB) or other interface between a computer and a peripheral such as the receiver if the receiver is separate from a computer (e.g., a wearable player, car receiver, home stereo unit receiver, and so on). If previewed content is purchased or acquired in an authorized manner then it is stored in nonvolatile memory, which may be personal memory, for reuse.

A typical purchase of content will be described below.

A user listens to the broadcast content either while in Live mode or in My XM mode listening to the preview content. As the user listens or navigates through the content, the user may choose content for purchase. The content or its ancillary data (e.g., PAD) is "flagged" by the device and placed in a memory location for later use during the purchase transaction.

The PAD includes an identifier relating to the vendor who owns the rights to the content. If the broadcast source owns the rights to the content, the device accesses the broadcast source network and using PAD data transacts for the acquisition of the "flagged" media. When the broadcast source does not own the rights to the "flagged" content, another third-party content vendor must be contacted to purchase the content. The PAD data facilitates this transaction because PAD may have identifiers that include vendor specific information, such as vendor name, URL, and a unique vendor identifier for the content, for example.

Once a user interface accesses a network, such as the Internet or cellular telephone, to communicate with the third party vendor, such as iTunes, the PAD is used to locate the content. A user interface facilitates the acquisition of the "flagged" content. After which, the content is provided to the user for personal use.

Instead of an on-line music vendor like iTunes, vendor data for a particular song may be related to an "unsigned band," for example. In this case, the PC software application would connect to a website or server of the unsigned band. The device 100 or PC software application receives authorization to obtain the selected song, through a purchase or otherwise. Then the website or server transfers the song to the user's PC. Rather than a PC and Internet connection, it should be understood that the transaction can occur via a wide variety of communication devices. For example, a device 100 according to an embodiment of the present invention may be connected to or incorporated into a digital cellular phone. In that case the cellular phone connects to the website or server of the "unsigned band" and completes the transaction, including receiving authorization through a purchase or otherwise, and optionally transferring the selected file to the user's cellular phone.

The content broadcast may be of lower quality due to a lower bit rate. If this is the case, the user may not want to purchase the exact content that was "flagged". Therefore, whenever possible, higher bit rate content to provide better quality content will be provided when the user acquires content for their personal use.

The content "flagged" by the user is stored in memory until the user decides to acquire the content. There are several ways this may be accomplished. The user may plug a device 100 into docking station connected to PC or use a USB cable to connect the device to a computer. The computer has installed an application program, such as PCR, that allows the user to interface with the broadcast content provider, unsigned band web sites, or third-part vendors.

In another embodiment the device 100 incorporated in a cellular device that allows the user to listen live to the broadcast content and has the capability to "flag" content. Built into the cellular device is an application that allows the user to purchase the content and receive the content over the high bandwidth cellular network. Alternatively, the device 100 is simply connected to a cellular device to perform the above functions.

Another embodiment preferably using a high bit rate network connection allows the user to immediately transfer content to as opposed to storing song information for later use. The network is preferably a high bit rate network so high quality content may be provided. The user may have an account with the content vendor that is debited whenever content is provided to the user device. Alternatively, the user may have a subscription that allows the user to acquire certain number of songs or other media. The above are only examples of acquisition methods and the invention should not be limited to those described.

The preceding description has used the example of digital audio content and the purchase of songs. However, it should be understood that any type digital media could be transmitted over a broadcast channel, stored and purchased, depending on the hardware limitations of the device. Digital audio is merely an exemplary media type used for purposes of explanation and ready understanding of the invention and the invention is not limited to audio content. The invention is suitable for use with video, graphics, text and other types of media.

We claim:

1. A method of providing a preview service in which content to be broadcast is pre-programmed and then broadcast for users, the method comprising the steps of:

receiving the broadcast in a user device, the user device being enabled via a valid subscription to receive the broadcast;

selecting desired content from the broadcast for storage;

recording said desired content on a non-volatile memory in the user device as it is received and without a recording authorization transaction; and playing back the desired content from the non-volatile memory for an amount of time selected from the group consisting of as many plural times as the user desires, an unlimited period of time, and a selected plural number of times;

wherein said broadcast comprises program associated data (PAD) ancillary to the content to uniquely identify the different segments in the content, the PAD being synchronized with segment transmission in the broadcast; and further comprising authorizing the permanent storage of said content in the non-volatile memory and selected by a user, said content being flagged by a user for permanent retention using the PAD, the PAD being stored and later utilized for acquisition;

verifying a purchase; and performing said authorizing step only after a verified purchase transaction, the acquired said content being a higher quality version for permanent storage.

2. The method of claim 1, further comprising the step of:

configuring said desired content in the non-volatile memory at the user device to store only content that meets the user specific criteria comprising at least one of time, channel, artist, duration and selected plural channels for simultaneous recording in the non-volatile memory.

3. The method of claim 1, wherein the broadcast comprises satellite digital audio radio service (SDARS) in a bit stream, the bit stream comprising a plurality of program channels to transmit different types of programs that are selected by at least one content provider for users to provide users with a spontaneous and diverse media experience, the plurality of segments corresponding to the programs.

4. The method of claim 1, further comprising storing at least part of the broadcast to a volatile memory as it is received for a selected period of time for time-shifted playback to a user;

wherein storing comprises storing selected said pre-programmed content on the non-volatile memory for at least one of a limited period of time and a selected number of times for playback in response to a record command during any of reception of the broadcast and the time-shifted playback.

5. A method of purchasing content broadcast by a content provider comprising:

a selecting step where at least one category of content is selected for a user to preview from a plurality of content categories being broadcast over a plurality of channels by a content provider;

a storing step where a device stores content and associated data from the at least one selected category of content in a volatile memory that is periodically updated during a broadcast by the content provider, the associated data allowing navigation among the stored content during playback;

a flagging step where a user listens to or views specific content stored in the storing step and flags that specific content for purchase;

a transferring step where the flagged content from the volatile memory used in the storing step is copied to a non-volatile memory;

an acquiring step where the associated data stored in the non-volatile memory is used to acquire a version of the flagged content;

a receiving step where at least one of the broadcast content provider and a content vendor provides the version of the flagged content to a user selected device based on the associated data for permanent storage; and a memory managing step where the non-volatile memory is managed by a user to store selected, plural tracks of content from the broadcast according to user preferences for time-shifted playback of the stored content, and to lock selected tracks from being erased or overwritten and allow a user more time to consider acquisition of the locked tracks for permanent storage.

6. The method according to claim 5, wherein the selecting step includes the step of the user selecting at least one channel to preview from the plurality channels broadcasting the selected content category.

7. The method according to claim 5, wherein the selecting step includes the step of the content provider selecting at least one channel from the plurality channels being broadcast for the user to preview.

8. The method according to claim 5, wherein the content stored in the storing step is a song and the associated data relates to any one of or all of from the following: the performing artist, composer, song title, song owner, a unique song identifier, or a database location.

9. The method according to claim 5, further comprising replacing said volatile memory and said non-volatile memory with a partitioned memory, wherein the storing step includes storing the selected content and associated data in said partitioned memory in lieu of said volatile memory, and the transferring steps and the memory managing steps comprise storing the data associated with flagged content and selected, plural tracks in said partitioned memory in lieu of said non-volatile memory.

10. The method according to claim 9, wherein the partitioned memory has partitions of memory that are automatically overwritten, partitions that store content that is user transferable, and partitions that store content that the user cannot transfer.

11. The method according to claim 9, wherein the partitioned memory has partitions of memory that are automatically overwritten, partitions that store content that is user accessible, and partitions that store content that the user cannot access.

12. The method according to claim 5, wherein the storing step includes performing the step of storing while the device is recharging.

13. The method according to claim 5, wherein the device while performing the storing step only stores content that meets predetermined quality standards.

14. The method according to claim 5, wherein the flagging step requires a user to press a button to flag the content for purchase while the user is listening to any portion of the content, or within a limited time period after the content has finished playing, or while the user scrolls through a listing of the content stored in the memory.

15. The method of claim 5, wherein the transferring step is performed by a second device different from the device containing the memory.

16. The method of claim 15, wherein the acquiring step is performed by a device different than the device storing the data in the memory location.

17. The method of claim 5, wherein the version of the flagged content in the acquiring step is a high quality version comprising substantially compact disc quality or better audio content.

18. A method of claim 5, wherein the transferring step is performed by the device after a user presses a button.

19. A broadcast receiving device comprising:

a receiver for receiving a plurality of channels of a plurality of categories of content that is broadcast by a content provider;

a playback memory for temporarily storing at part of the broadcast to buffer live broadcast content as the user listens to the received broadcast and allow replay operations comprising pausing, rewinding and fast forwarding playback of the broadcast being received and skipping selected said segments in said stored broadcast during playback;

a selector to select at least one category of content for a user to preview from the plurality of content categories being broadcast over a plurality of channels by said content provider;

a preview memory wherein the device stores content and associated data from the at least one selected category of content in said preview memory and allows a user limited access to the content stored therein;

an input device a user actuates to flag specific content for purchase when the user listens to or views specific content;

a microprocessor that copies or transfers the data associated with the flagged content from the playback memory to the preview memory;

wherein the associated data stored in the preview memory is user accessible so the user can acquire a version of the flagged content; and a permanent memory that stores the version of the flagged content and provides a user with unlimited access to it.

20. The broadcast receiving device of claim 19, wherein the selector is controlled by the user to select content for preview.

21. The broadcast receiving device of claim 20, wherein the cellular telephone is the user selected device for the downloading step.

22. The broadcast receiving device of claim 19, wherein:

the radio frequency receiving device is cellular telephone; and the downloaded high quality version of the flagged content is stored in memory on the cellular telephone.

23. The cellular telephone that performs the method of claim 19, wherein the cellular telephone is the user selected device for the downloading step.

24. A method of purchasing content broadcast by a broadcast source comprising:

a selecting step where content is selected by a user to preview from a broadcast over a plurality of channels by a content provider;

a storing step where a device stores content and associated data from selected content in a first memory that is periodically updated;

a flagging step where a user listens to or views specific content stored in the storing step and flags that specific content for acquisition;

a transferring step where the device copies the data associated with the flagged content from the first memory used in the storing step to a second memory for semi-permanent storage and greater user access for time-shifted playback of the stored content than is provided via the first memory;

an acquiring step where the associated data stored in said second memory location is used to acquire a high quality version of the flagged content; and a delivering step where at least one of a broadcast content provider and a content vendor delivers a high quality version of the flagged content to a user selected device for permanent storage and unlimited user access.

25. The method according to claim 24, wherein the selecting step includes the step of the user selecting at least one channel to preview from the plurality channels being broadcast.

26. The method according to claim 24, wherein the content stored in the storing step is a song and the associated data relates to any one of or all of the following: the performing artist, composer, song title, song owner, a unique song identifier, or a database location.

27. The method according to claim 24, wherein the first memory and the second memory are implemented as a partitioned memory, the storing step includes storing the selected content and associated data in the partitioned memory.

28. The method according to claim 27, wherein the partitioned memory has partitions of memory that are automatically overwritten, partitions that store content that is user transferable, and partitions that store content that the user cannot transfer.

29. The method according to claim 27, wherein the partitioned memory has partitions of memory that are automatically overwritten, partitions that store content that is user accessible, and partitions that store content that the user cannot access.

30. The method according to claim 24, wherein the storing step includes performing the step of storing while the device is recharging.

31. The method according to claim 24, wherein the device while performing the storing step only stores content that meets predetermined quality standards.

32. The method according to claim 24, wherein the flagging step requires a user to identify the content for purchase while the user is listening to any portion of the content, or within a limited time period after the content has finished playing, or while the user scrolls through a listing of the content stored in the memory.

33. The method of claim 24, wherein the transferring step is performed by the device after a user presses a button.

34. The method of claim 24, wherein the transferring step is performed by a second device different from the device containing the memory.

35. The method of claim 34, wherein the purchase step is performed by a device different than the device storing the data in said memory locations.

36. The method of claim 24, wherein the high quality version of the flagged content in the purchasing step is substantially compact disc quality or better audio content.

37. The method of claim 24, wherein the content is video content.

38. The method of claim 24, wherein the purchasing step further comprises:

the step of transacting with a third party vendor of the flagged content for the purchase price of the flagged content.

* * * * *